US008116507B2

(12) United States Patent
Wada et al.

(10) Patent No.: US 8,116,507 B2
(45) Date of Patent: Feb. 14, 2012

(54) ELECTRONIC APPARATUS

(75) Inventors: Takanobu Wada, Saitama (JP); Atsushi Miyata, Kanagawa (JP)

(73) Assignee: Sony Corporation, Tokyo (JP)

( * ) Notice: Subject to any disclaimer, the term of this patent is extended or adjusted under 35 U.S.C. 154(b) by 392 days.

(21) Appl. No.: 12/502,531

(22) Filed: Jul. 14, 2009

(65) Prior Publication Data

US 2010/0034417 A1 Feb. 11, 2010

(30) Foreign Application Priority Data

Aug. 11, 2008 (JP) ..... 2008-206635

(51) Int. Cl.
*H04R 25/00* (2006.01)

(52) U.S. Cl. ..... 381/388; 381/333; 381/391

(58) Field of Classification Search ..... 381/306, 381/332, 333, 334, 335, 386, 388, 391, 189; 181/141, 150, 156, 199; 361/679.23, 679.26, 361/679.55
See application file for complete search history.

(56) References Cited

U.S. PATENT DOCUMENTS 6,999,595 B2 * 2/2006 Anderson et al. ..... 381/333
7,471,804 B2 * 12/2008 Lee ..... 381/388
7,861,825 B2 * 1/2011 Stewart et al. ..... 181/252

FOREIGN PATENT DOCUMENTS

JP 2007-233402 9/2007

* cited by examiner

*Primary Examiner* — Huyen D Le
(74) *Attorney, Agent, or Firm* — Oblon, Spivak, McClelland, Maier & Neustadt, L.L.P.

(57) ABSTRACT

An electronic apparatus includes an electronic-apparatus housing provided with a sound release hole, a speaker unit housed in the electronic-apparatus housing and facing the sound release hole, a grille body made of a conductive material, configured to allow sound to pass therethrough, and having a plate-like shape that is of sufficient size to cover the sound release hole, a frame made of an insulating material and detachably attached to the electronic-apparatus housing while supporting the grille body, such that the grille body covers the sound release hole, a cushion member provided on the frame and having elasticity and conductivity that allows the cushion member to be electrically continuous with the grille body, and a conductive member grounded inside the electronic-apparatus housing and, when the frame is attached to the electronic-apparatus housing, becoming electrically continuous with the grille body through the cushion member.

6 Claims, 22 Drawing Sheets

ELECTRONIC APPARATUS

BACKGROUND OF THE INVENTION

1. Field of the Invention

The present invention relates to electronic apparatuses.

2. Description of the Related Art

In general, electronic apparatuses such as television receivers and display apparatuses each include a housing configured to support a display panel, a speaker unit housed in the housing so as to face a sound release hole provided in the housing, and a speaker grille allowing sound to pass therethrough and covering the sound release hole. An example of such an electronic apparatus is disclosed in Japanese Unexamined Patent Application Publication No. 2007-233402.

From the viewpoint of improving the design of such an electronic apparatus, it is desired that the speaker grille to be attached to the housing be prepared with various designs beforehand so that a user can choose a preferred one.

SUMMARY OF THE INVENTION

In many cases, speaker grilles are made of conductive materials, such as metal, for their aesthetic texture and appearance. Therefore, to prevent electrostatic charging, it is important to assuredly ground speaker grilles.

In view of the above, it is desirable to provide an electronic apparatus that is advantageous in that a speaker grille removably provided on a housing is assuredly grounded.

According to an embodiment of the present invention, an electronic apparatus includes an electronic-apparatus housing provided with a sound release hole, a speaker unit housed in the electronic-apparatus housing and facing the sound release hole, a grille body made of a conductive material, configured to allow sound to pass therethrough, and having a plate-like shape that is of sufficient size to cover the sound release hole, a frame made of an insulating material and detachably attached to the electronic-apparatus housing while supporting the grille body, such that the grille body covers the sound release hole, a cushion member provided on the frame and having elasticity and conductivity that allows the cushion member to be electrically continuous with the grille body, and a conductive member grounded inside the electronic-apparatus housing and, when the frame is attached to the electronic-apparatus housing, becoming electrically continuous with the grille body through the cushion member.

In the above embodiment, the grille body and the frame are attached to the electronic-apparatus housing, whereby the grille body is grounded through the cushion member and the conductive member.

Therefore, in a case where a grille body made of a conductive material is removably provided on an electronic-apparatus housing, the above electronic apparatus is advantageous in that the grille body is assuredly grounded and electrostatic charging is prevented.

DESCRIPTION OF THE PREFERRED EMBODIMENTS

Embodiments of the present invention will now be described with reference to the drawings.

Figure 1:
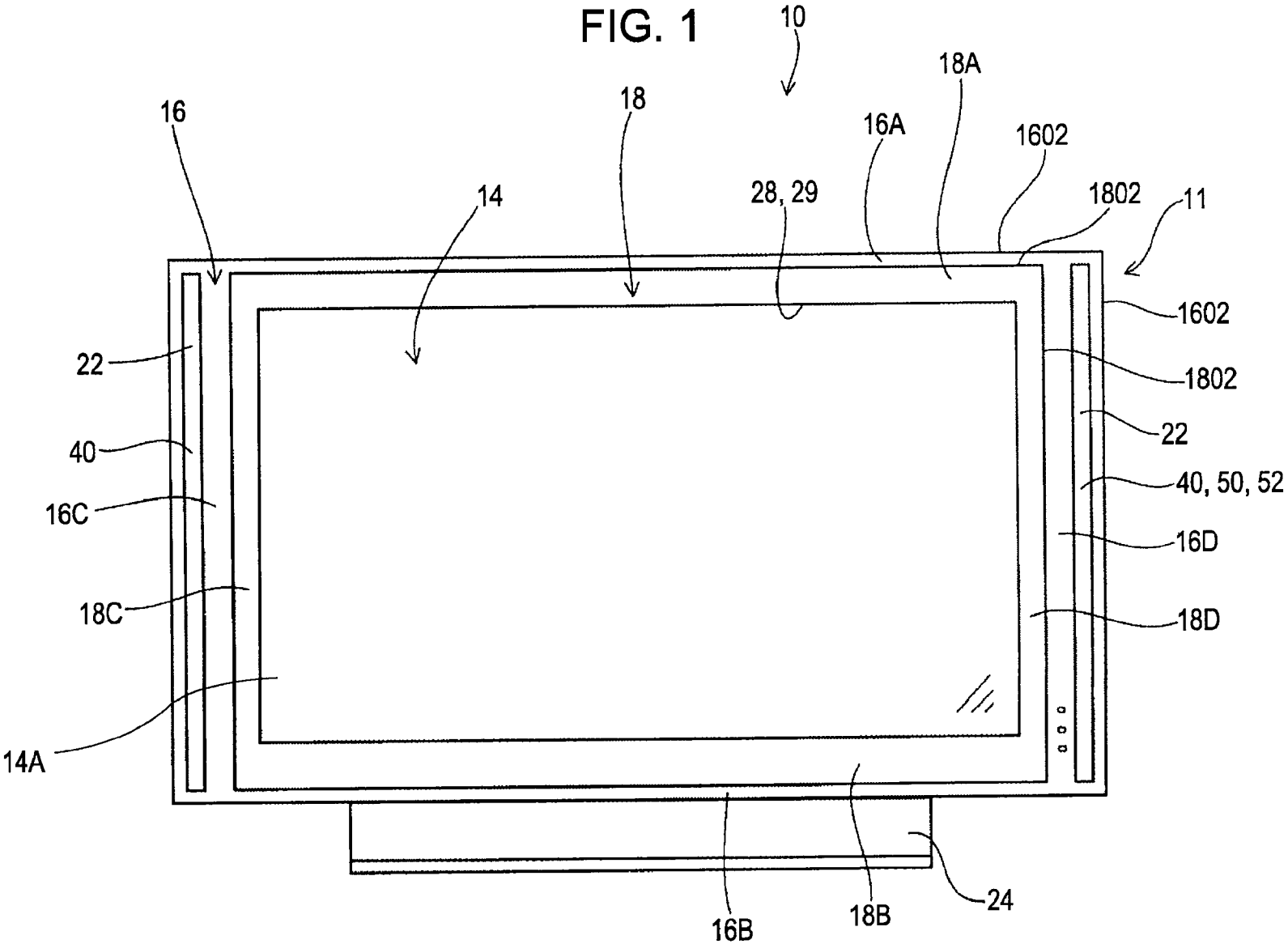
FIG. 1 is a front view of an electronic apparatus 10 according to an embodiment of the present invention.
Figure 2:
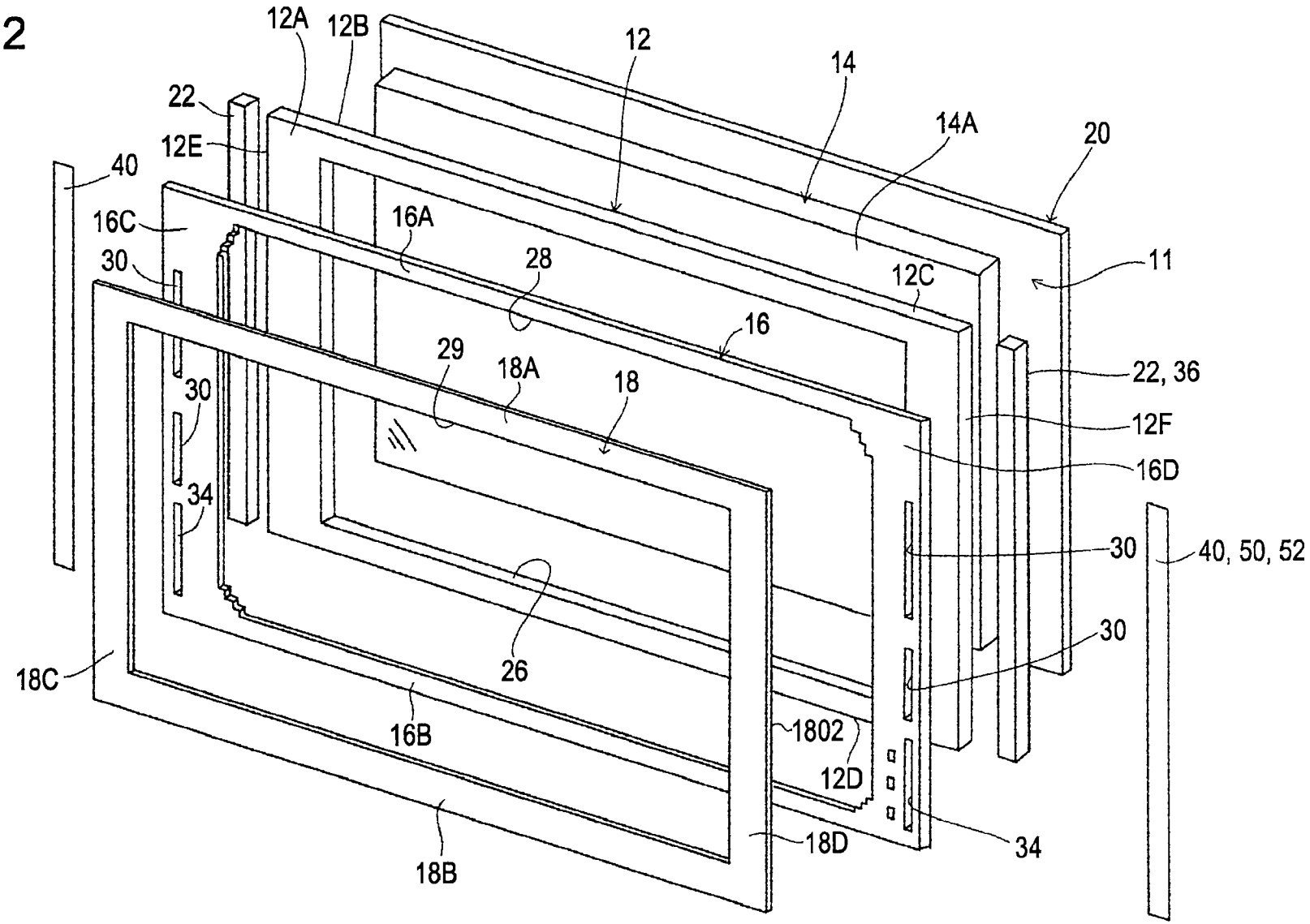
FIG. 2 is an exploded perspective view of the electronic apparatus 10.

FIG. 1 is a front view of an electronic apparatus 10 according to an embodiment of the present invention. FIG. 2 is an exploded perspective view of the electronic apparatus 10.

This embodiment concerns a case where the electronic apparatus 10 is a television receiver or a display apparatus.

Referring to FIGS. 1 and 2, the electronic apparatus 10 includes an electronic-apparatus housing 11. The electronic-apparatus housing 11 includes a center panel 16, a front panel 18, a rear panel 20, left and right speakers 22, and so forth, and houses a display panel 14.

Electronic-Apparatus Housing 11

The electronic-apparatus housing 11 includes a housing main body 12, the center panel 16, and speaker boxes 36. The speaker boxes 36 will be described separately below.

Referring to FIG. 2, the housing main body 12 houses and supports the display panel 14.

The housing main body 12 has a flat, thin, rectangular frame-like shape with a certain anteroposterior thickness, a vertical height larger than the thickness, and a horizontal width larger than the height.

In this embodiment, the left and right of the electronic apparatus 10 denote respective sides thereof when seen from the side of a screen 14A of the display panel 14.

The housing main body 12 has a front face 12A facing the front, a rear face 12B facing the rear, a top face 12C at the top, a bottom face 12D at the bottom, a left face 12E on the left, and a right face 12F on the right.

A stand 24 (FIG. 1) projects downward from the center of the bottom face 12D.

The housing main body 12 has in the vertical and horizontal center thereof a housing portion 26, which is a rectangular opening whose width is larger than the height thereof. The display panel 14 is housed in the housing portion 26.

Display Panel 14

Referring to FIG. 2, the display panel 14 has a flat, thin, rectangular plate-like shape with a certain anteroposterior thickness, a vertical height larger than the thickness, and a horizontal width larger than the height.

The display panel 14 has one of faces in the thickness direction thereof serving as the screen 14A on which an image such as a moving image or a still image is displayed, and the other face thereof being defined as a rear face.

The display panel 14 is housed in the housing portion 26, whereby the screen 14A is positioned at the front face 12A of the housing main body 12 so as to face the front.

The display panel 14 of this embodiment is a liquid crystal display panel. Alternatively, the display panel 14 may be any of other common display panels, such as an organic electroluminescent (EL) display panel and a plasma display panel.

Center Panel 16

The center panel 16 has a rectangular frame-like shape with a certain anteroposterior thickness, a vertical height larger than the thickness, and a horizontal width larger than the height.

The center panel 16 is made of any of various common synthetic resins such as polycarbonate resin and acrylic resin. In this embodiment, the center panel 16 is made of a synthetic resin allowing light to pass therethrough.

Referring to FIG. 2, the center panel 16 is attached to the front face 12A of the housing main body 12 and has a first opening 28 having a rectangular shape and exposing the screen 14A to the front.

The center panel 16 has a top member 16A and a bottom member 16B positioned at the top and the bottom, respectively, of the first opening 28, and a left member 16C and a right member 16D positioned on the left and the right, respectively, of the first opening 28.

Figure 8:
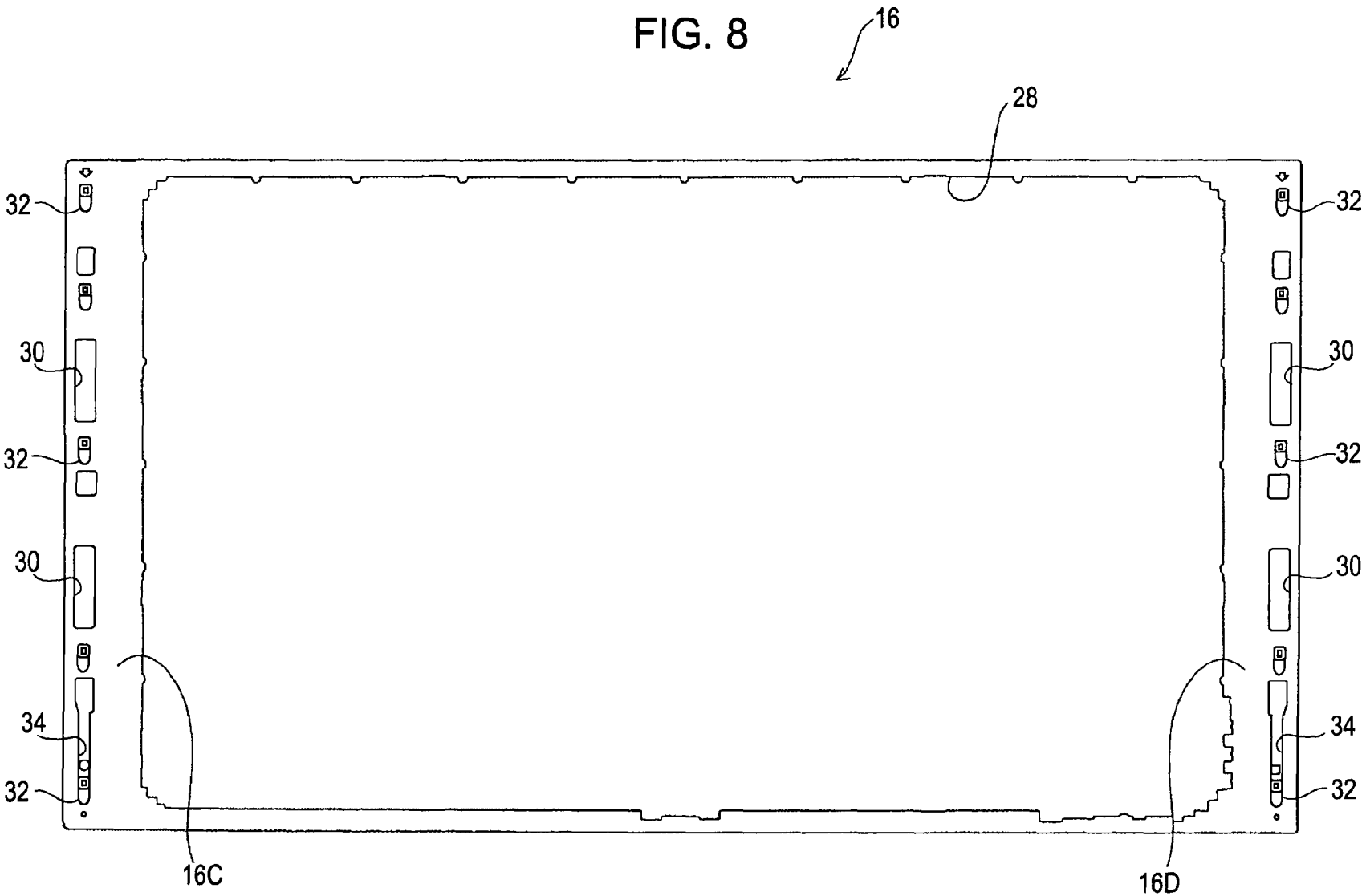
FIG. 8 is a plan view of a center panel 16.
Figure 9:
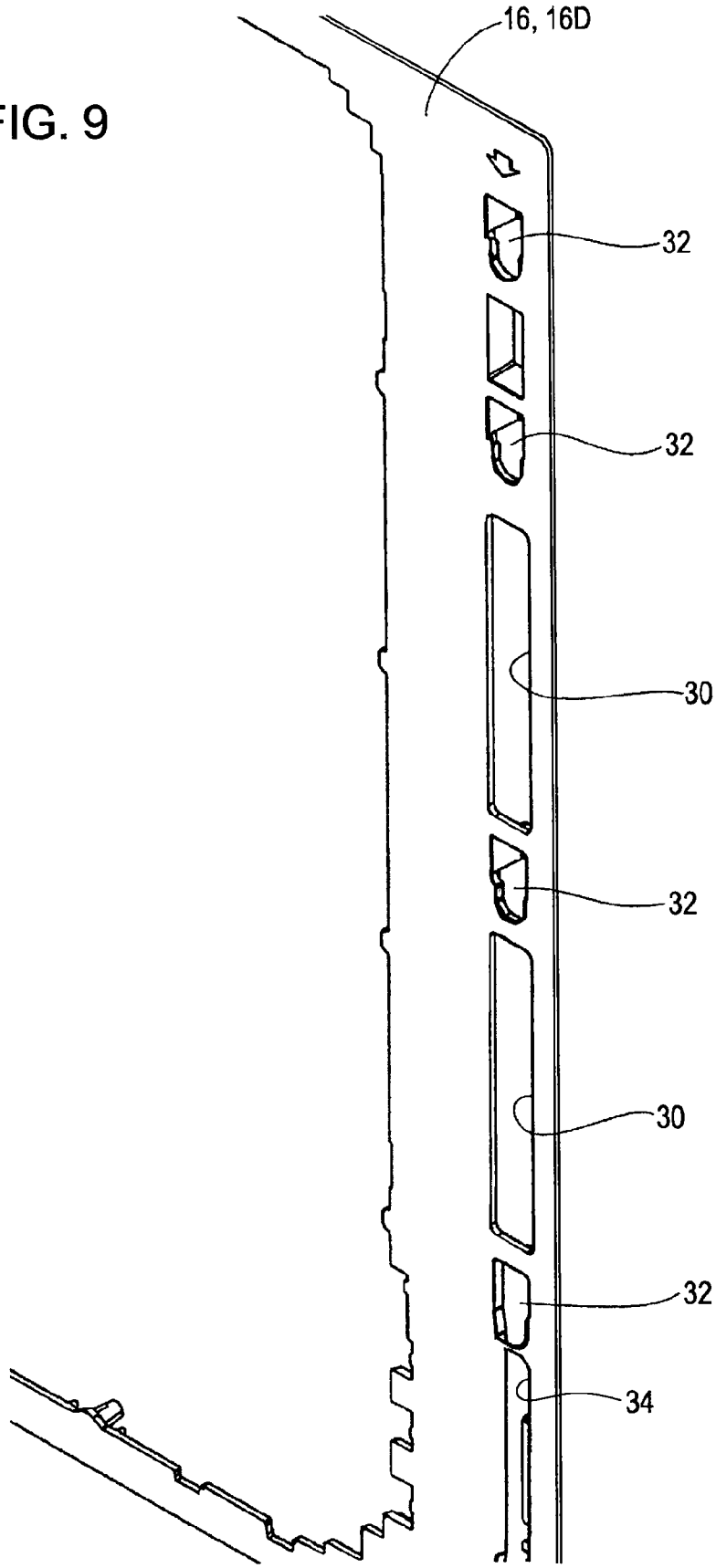
FIG. 9 is a perspective view showing a right member 16D of the center panel 16.
Figure 10:
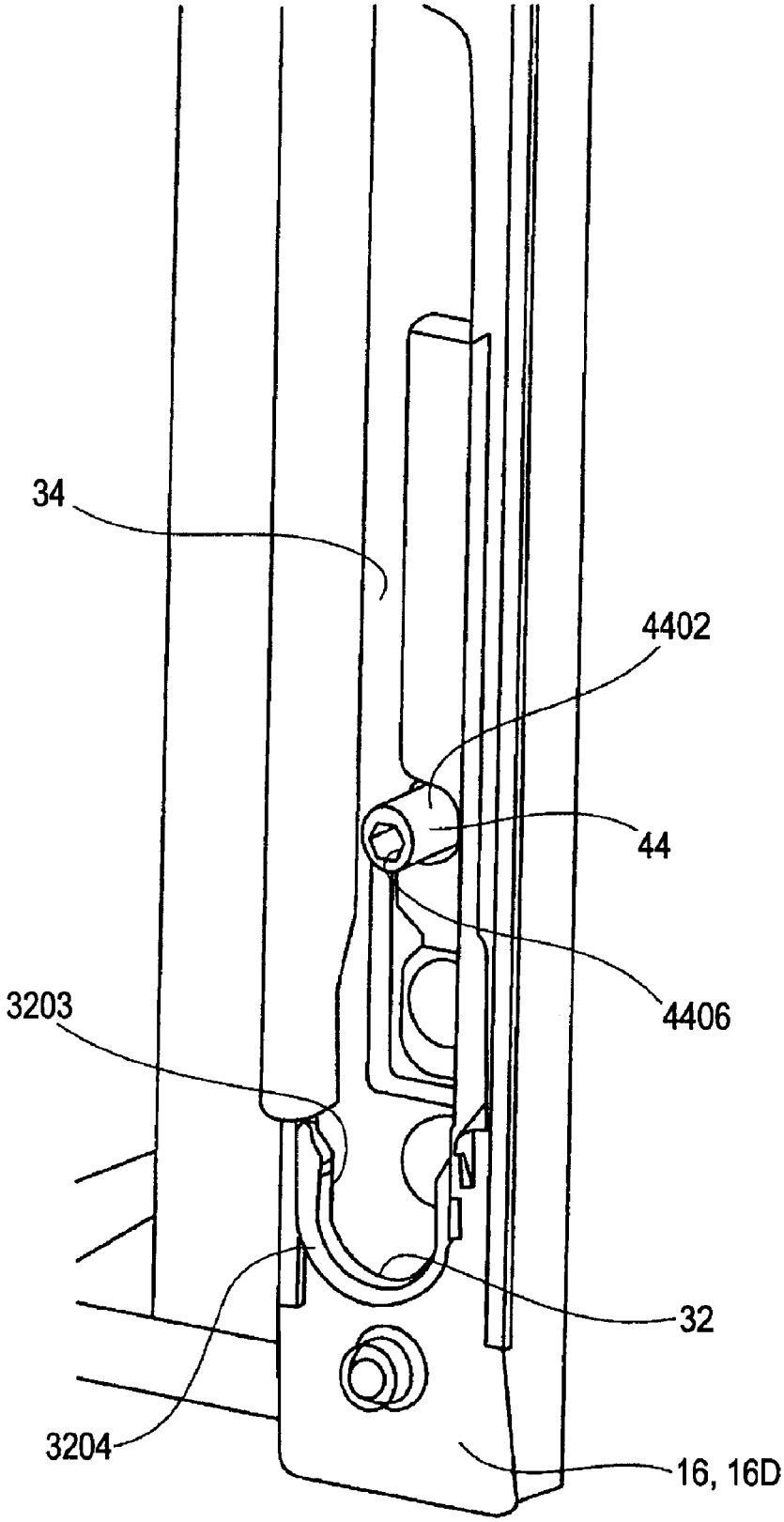
FIG. 10 is a perspective view showing a lower portion of the right speaker 22, with a corresponding speaker grille 40 removed.

Referring to FIGS. 8, 9, and 10, the left member 16C and the right member 16D each have two sound release holes 30, five fitting portions 32, and one conduction opening 34.

The two sound release holes 30 allow sound, which is output from speaker units 38 described separately below, to pass therethrough toward the front. The sound release holes 30 provided in each of the left member 16C and the right member 16D are vertically spaced apart from each other with respect to the vertical center of the corresponding member 16C or 16D.

The five fitting portions 32 releasably engage with respective fitting members 58 (FIG. 15), whereby a speaker grille 40 is held. The fitting portions 32 in each of the left member 16C and the right member 16D are arranged vertically with intervals therebetween.

Figure 11A:
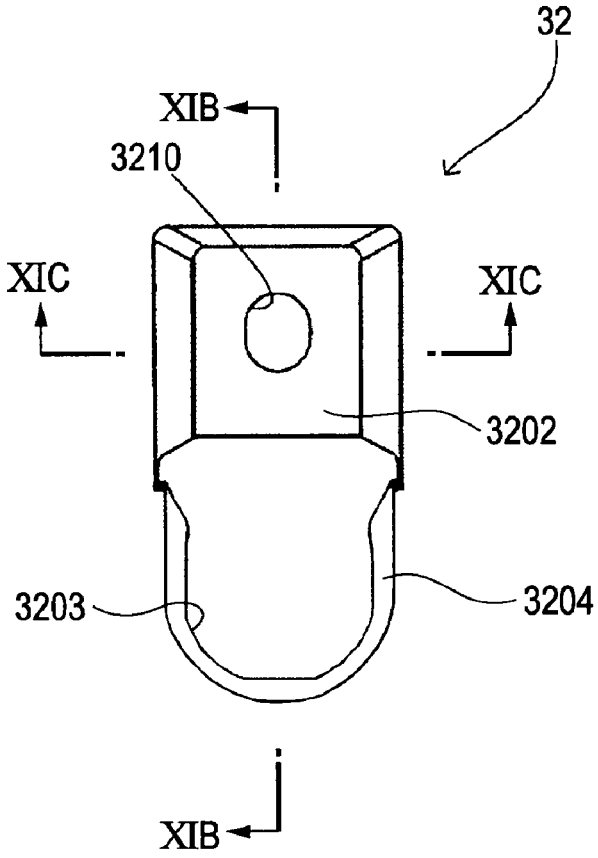
FIGS. 11A, 11B, 11C are a front view of one of fitting portions 32, a sectional view taken along the line XIB-XIB in FIG. 11A, and a sectional view taken along the line XIC-XIC in FIG. 11A, respectively.
Figure 11B:
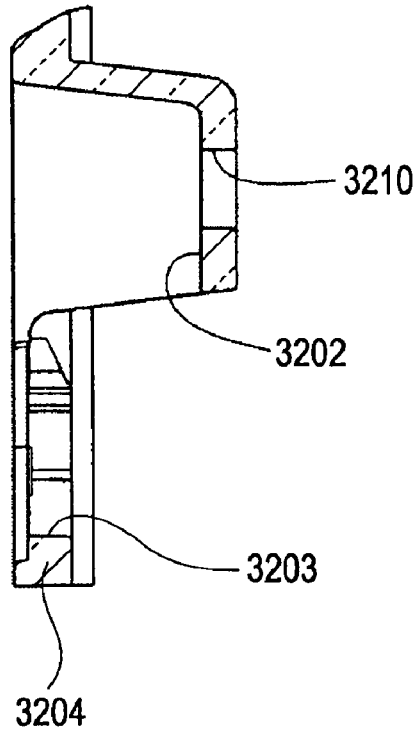
Figure 11C:
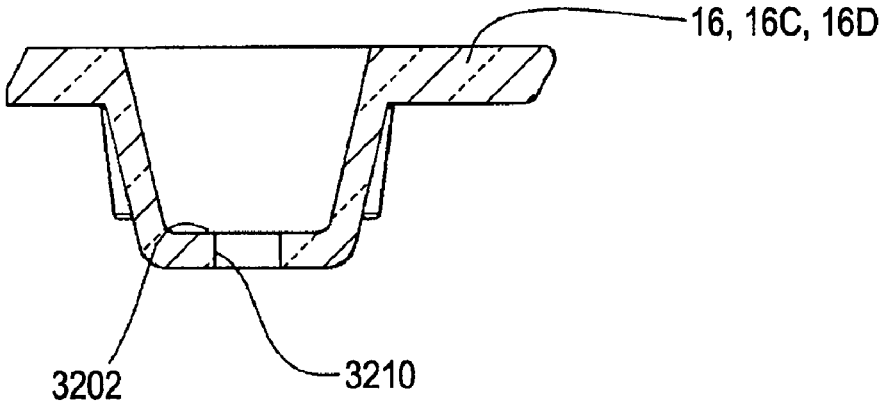

Referring to FIGS. 11A to 11C, each of the fitting portions 32 has a recess 3202 recessed rearward from a corresponding one of the left and right members 16C and 16D, an opening 3203 provided below the recess 3202, and an engaging rim 3204 having a U shape around the left, bottom, and right sides of the opening 3203.

The recess 3202 has a screw hole 3210 bored in the bottom thereof.

Referring to FIG. 10, one of the five fitting portions 32 at the lowermost position has only the opening 3203 and the engaging rim 3204, with no recess 3202.

The conduction opening 34 allows contact between a cushion member 42 (FIG. 3) and a conductive member 44. The conduction opening 34 is defined by a rim continuing from the engaging rim 3204 of the fitting portion 32 at the lowermost position of each of the left and right members 16C and 16D.

Front Panel 18

Referring to FIG. 2, the front panel 18 has a rectangular frame-like shape with a certain anteroposterior thickness, a vertical height larger than the thickness, and a horizontal width larger than the height.

The front panel 18 is made of any of various common synthetic resins. In this embodiment, the front panel 18 is made of a synthetic resin that blocks light.

The front panel 18 is attached to the face of the center panel 16 opposite the face adjoining the front face 12A of the housing main body 12, and has a second opening 29 having a rectangular shape. The screen 14A is exposed to the front through the first opening 28 and the second opening 29.

The front panel 18 has a top member 18A and a bottom member 18B positioned at the top and the bottom, respectively, of the second opening 29, and a left member 18C and a right member 18D positioned on the left and the right, respectively, of the second opening 29.

Referring to FIG. 1, when seen from the front side of the display panel 14, outer edges 1602 of the top, bottom, left, and right members 16A, 16B, 16C, and 16D of the center panel 16 extend beyond the outer edges 1802 of the top, bottom, left, and right members 18A, 18B, 18C, and 18D of the front panel 18.

In short, the left and right members 16C and 16D of the center panel 16 extend beyond the left and right members 18C and 18D of the front panel 18 toward left and right, respectively.

Rear Panel 20

The rear panel 20 has a rectangular plate-like shape and is attached to the rear face 12B of the housing main body 12, thereby covering the rear face 12B and the rear face of the display panel 14.

Left and Right Speakers 22

Figure 3:
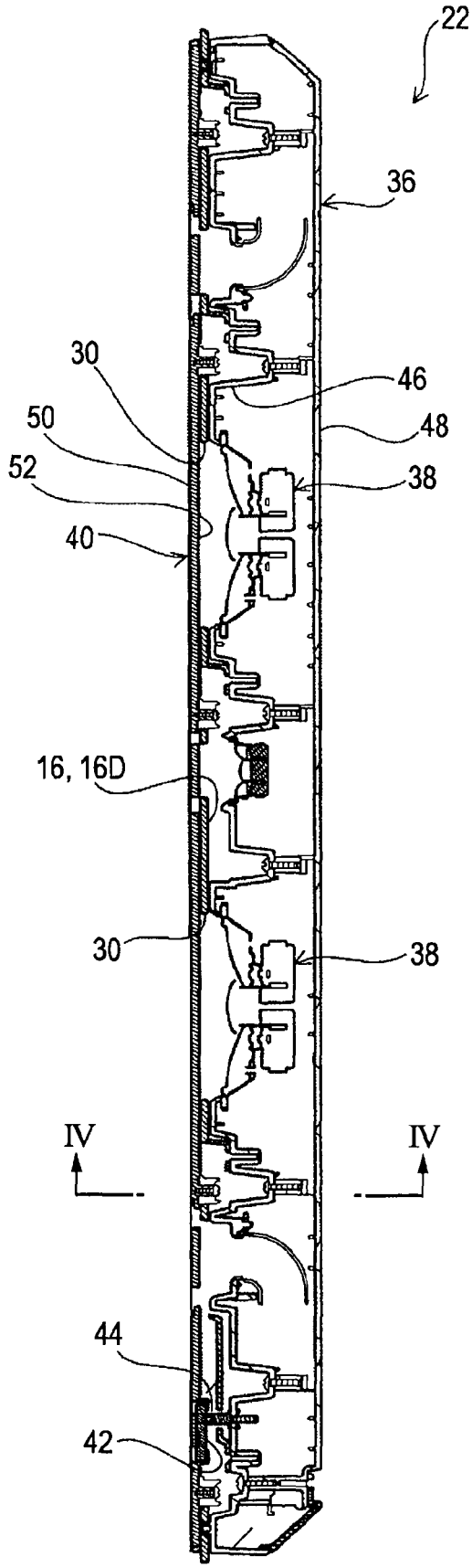
FIG. 3 is a longitudinal sectional view of one of left and right speakers 22.
Figure 4:
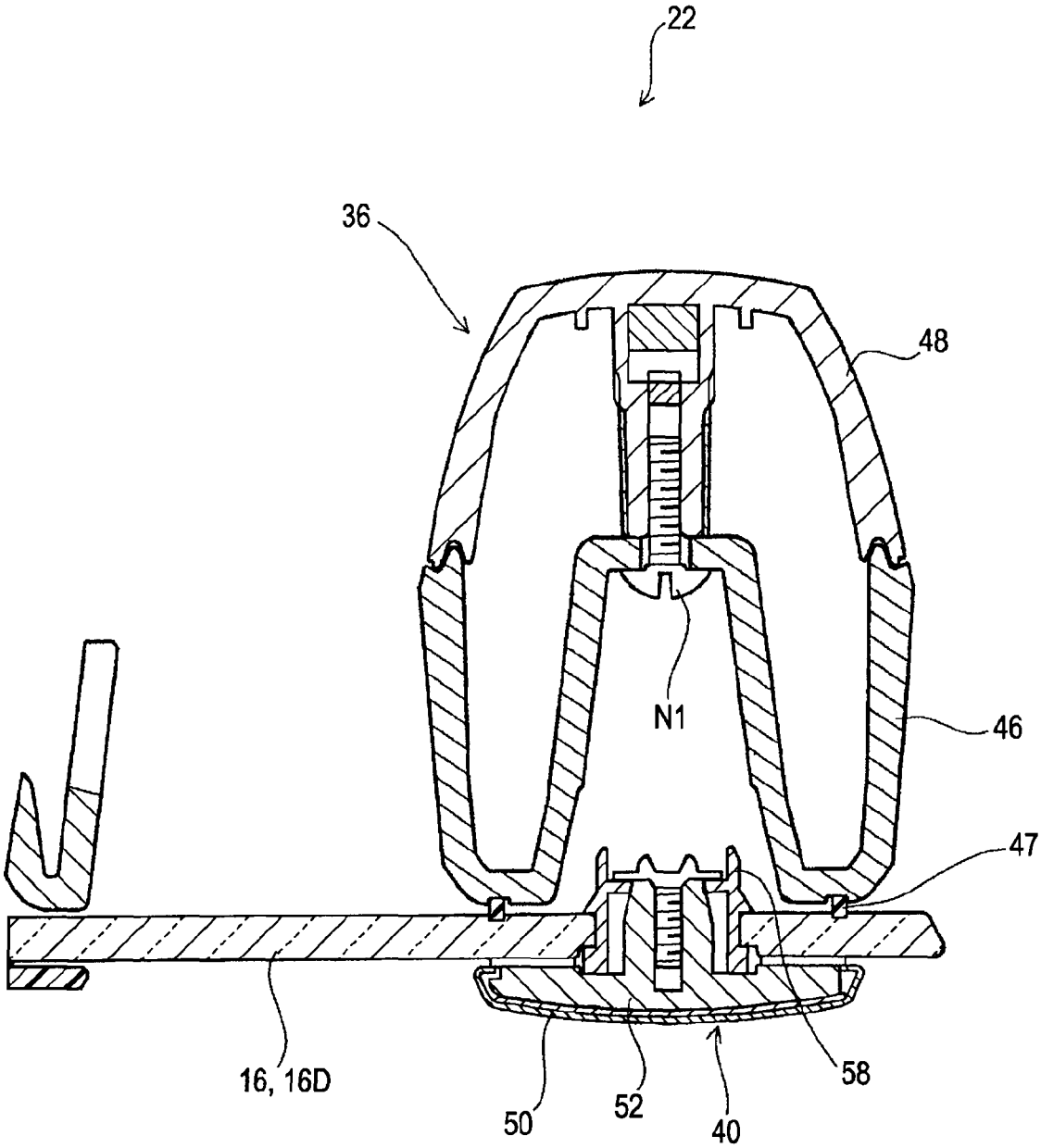
FIG. 4 is a sectional view taken along the line IV-IV in FIG. 3.

FIG. 3 is a longitudinal sectional view of one of the speakers 22. FIG. 4 is a sectional view taken along the line IV-IV in FIG. 3.

Figure 5:
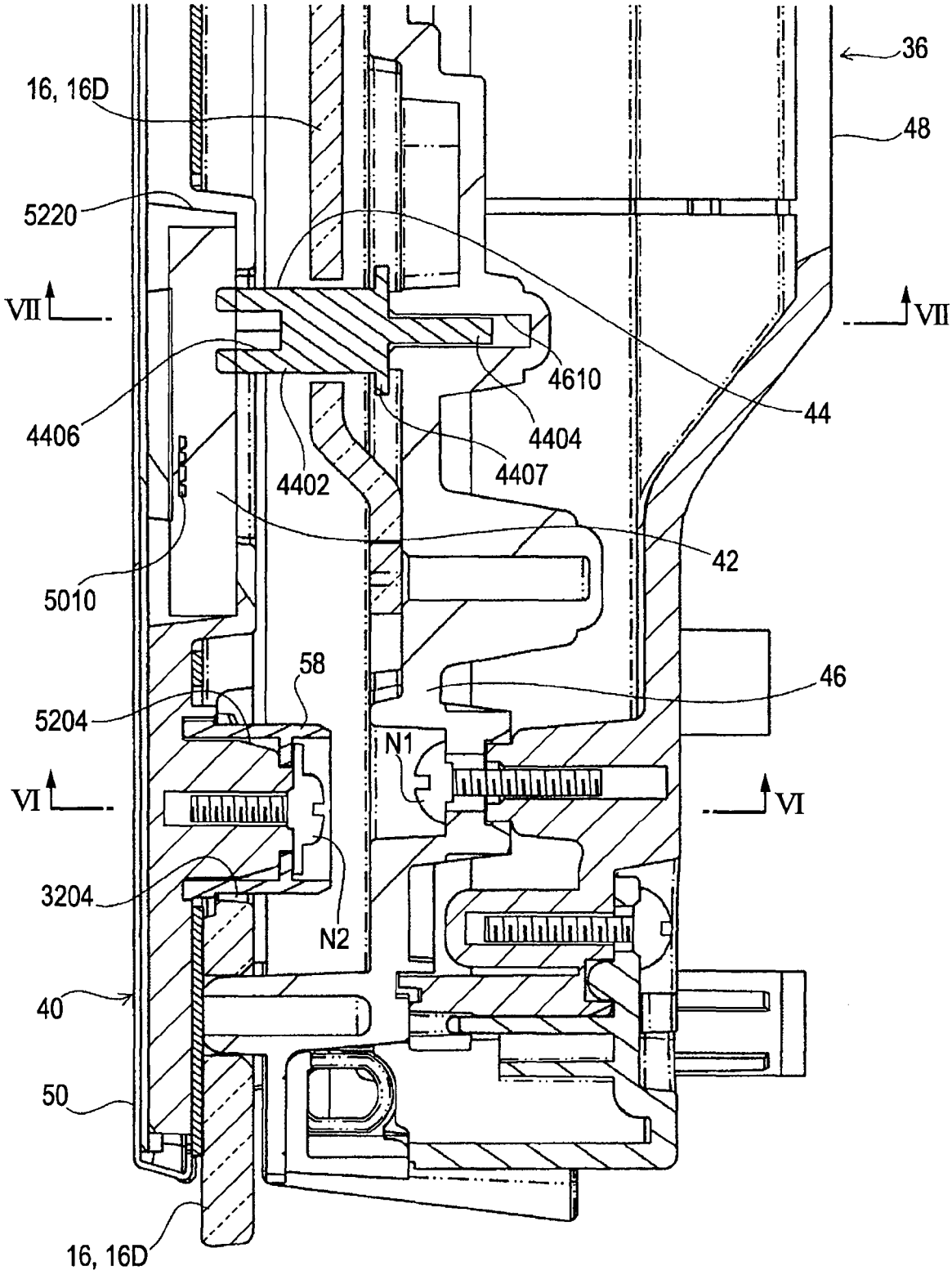
FIG. 5 is a longitudinal sectional view showing a lower portion of the speaker 22.
Figure 6:
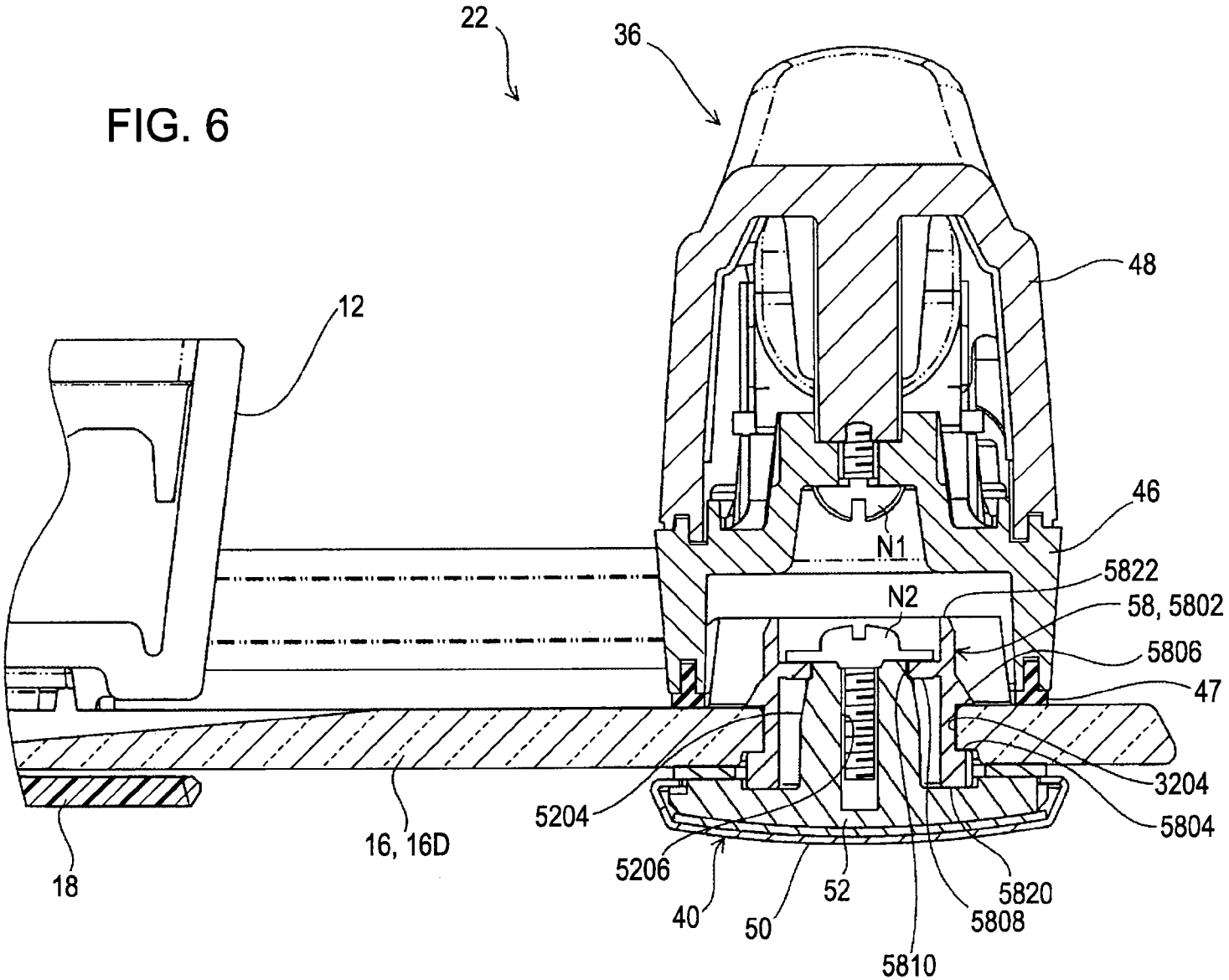
FIG. 6 is a sectional view taken along the line VI-VI in FIG. 5.
Figure 7:
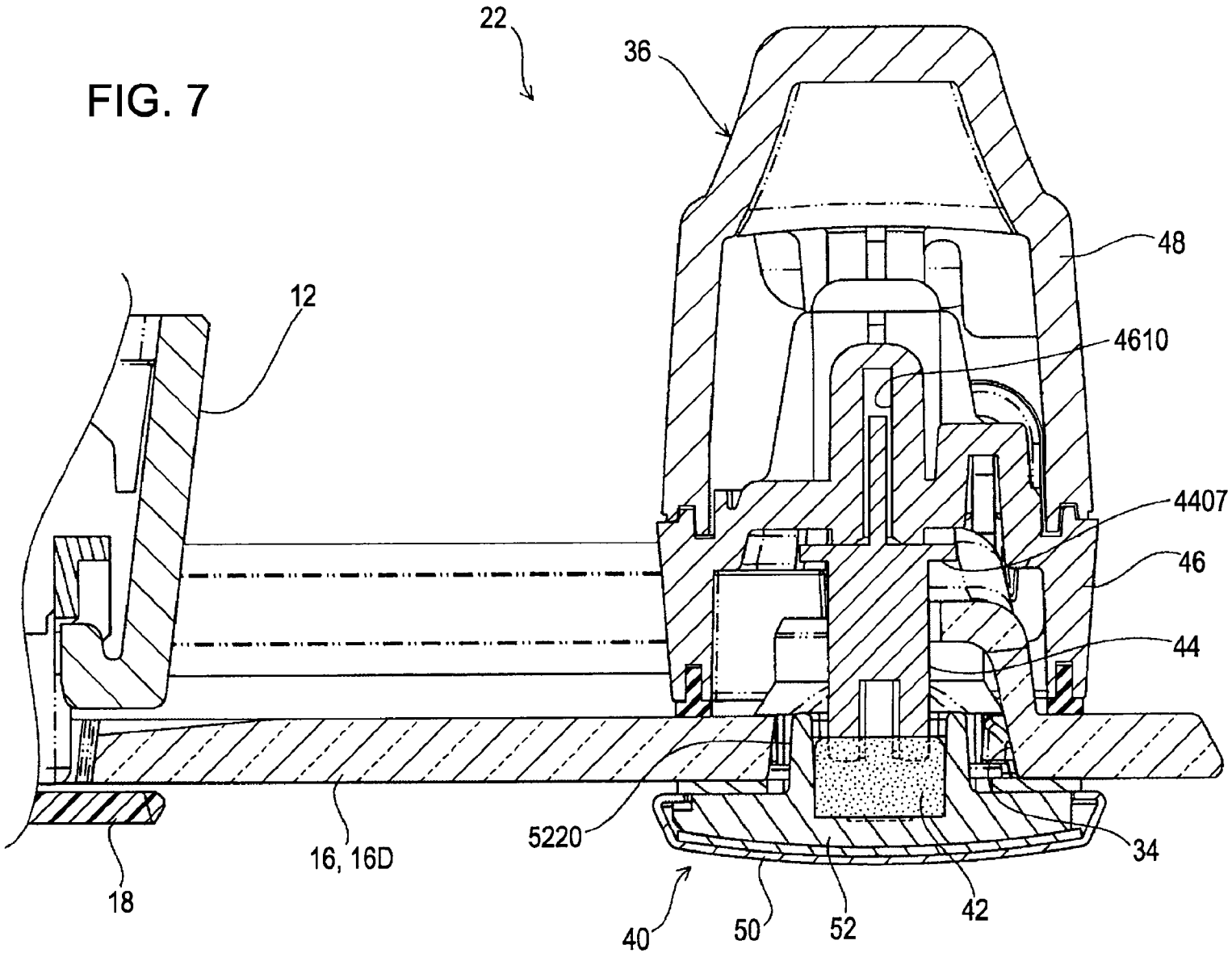
FIG. 7 is a sectional view taken along the line VII-VII in FIG. 5.

FIG. 5 is a longitudinal sectional view showing a lower portion of the speaker 22. FIG. 6 is a sectional view taken along the line VI-VI in FIG. 5. FIG. 7 is a sectional view taken along the line VII-VII in FIG. 5.

FIG. 8 is a plan view of the center panel 16. FIG. 9 is a perspective view showing the right member 16D of the center panel 16.

FIG. 10 is a perspective view showing a lower portion of the right speaker 22, with the corresponding speaker grille 40 removed.

FIG. 11A is a front view of one of the fitting portions 32. FIG. 11B is a sectional view taken along the line XIB-XIB in FIG. 11A. FIG. 11C is a sectional view taken along the line XIC-XIC in FIG. 11A.

Figure 12:
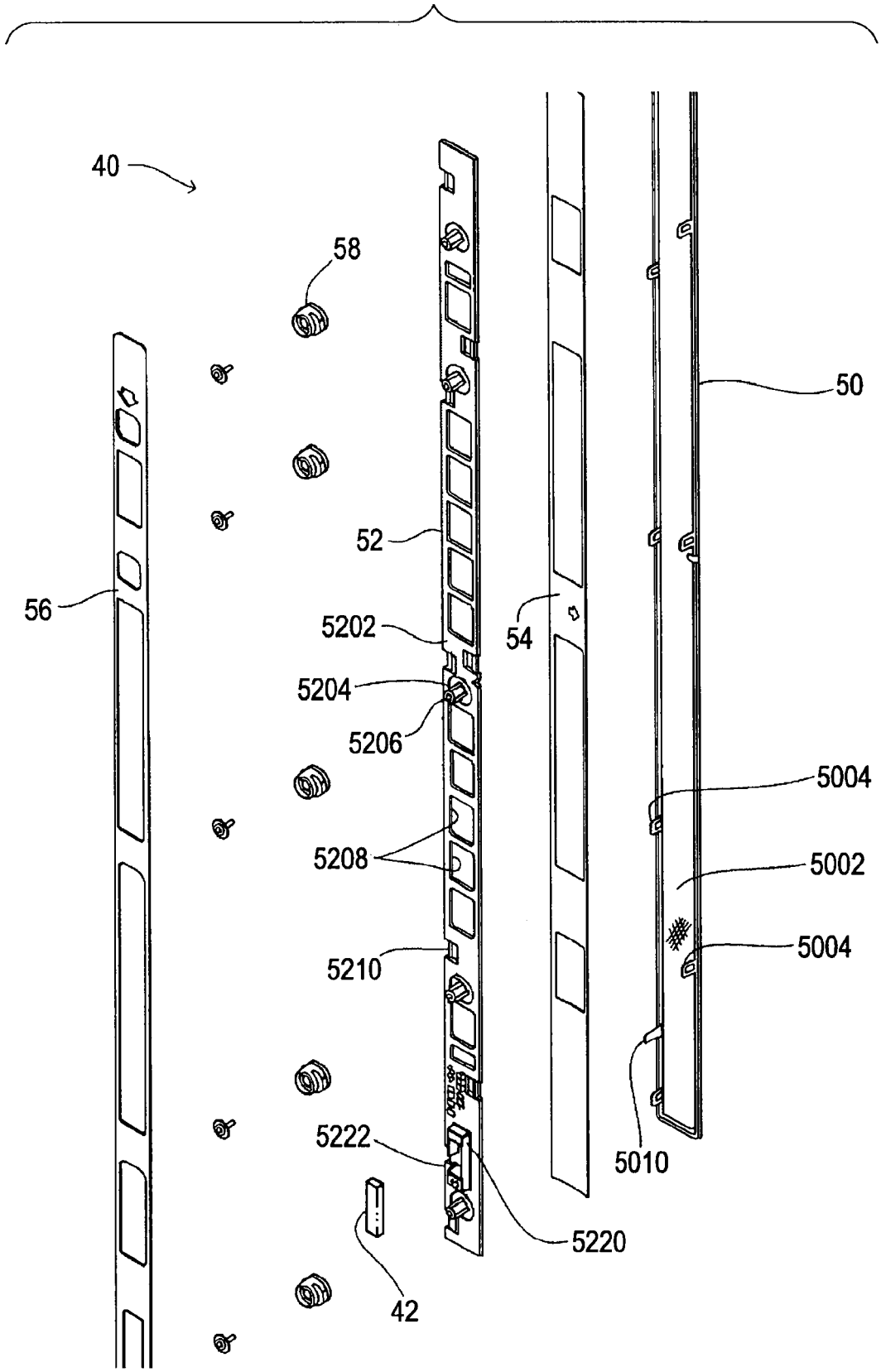
FIG. 12 is an exploded perspective view of the speaker grille 40.

FIG. 12 is an exploded perspective view of the speaker grille 40.

Figure 13A:
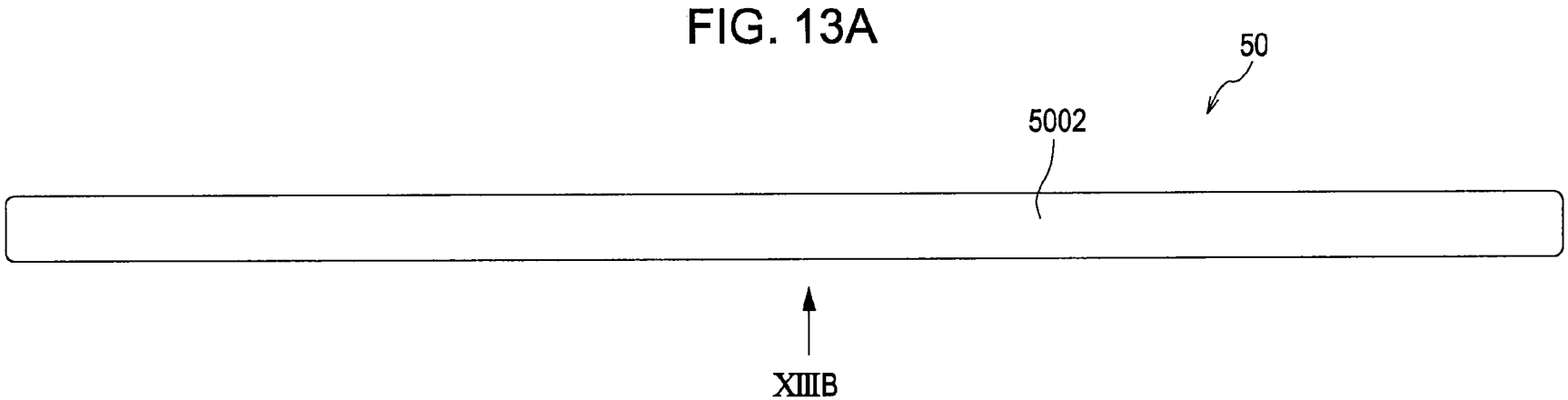
FIGS. 13A and 13B are a plan view of a grille body 50 and a side view of the grille body 50 seen in the direction of the arrow XIIIB in FIG. 13A, respectively.
Figure 13B:
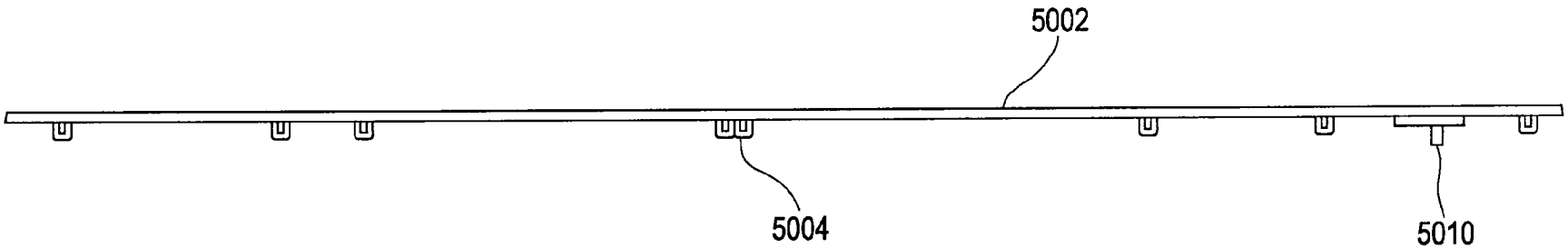

FIG. 13A is a plan view of a grille body 50. FIG. 13B is a side view of the grille body 50 seen in the direction of the arrow XIIIB in FIG. 13A.

Figure 14A:
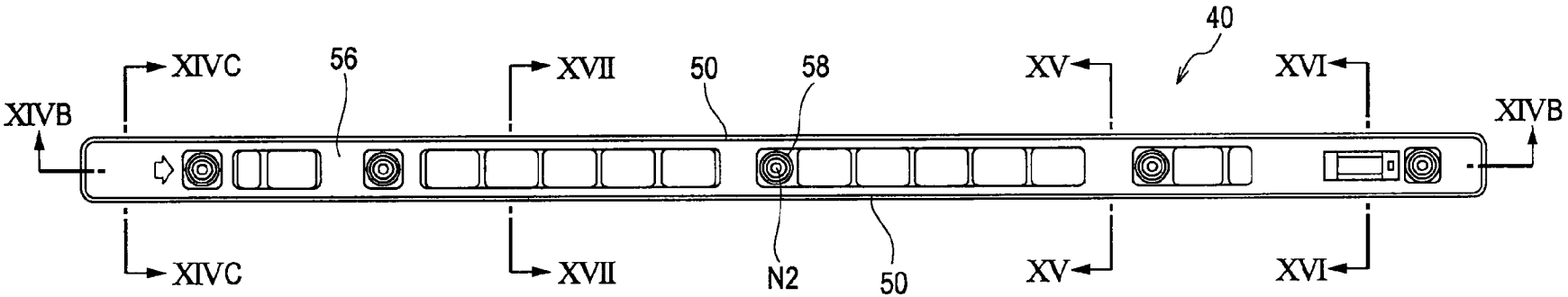
FIGS. 14A, 14B, and 14C are a rear view of the speaker grille 40, a sectional view taken along the line XIVB-XIVB in FIG. 14A, and a sectional view taken along the line XIVC-XIVC in FIG. 14A, respectively.
Figure 14B:
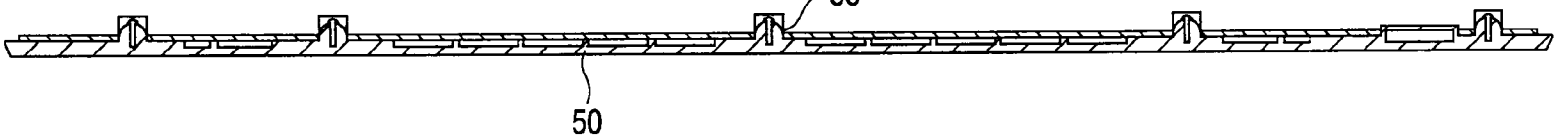
Figure 14C:
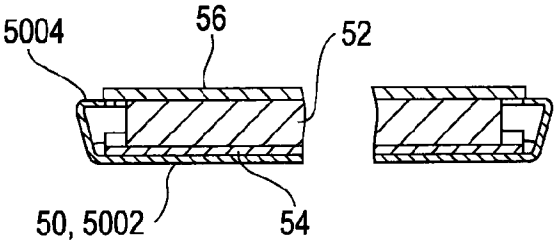

FIG. 14A is a rear view of the speaker grille 40. FIG. 14B is a sectional view taken along the line XIVB-XIVB in FIG. 14A. FIG. 14C is a sectional view taken along the line XIVC-XIVC in FIG. 14A.

Figure 15:
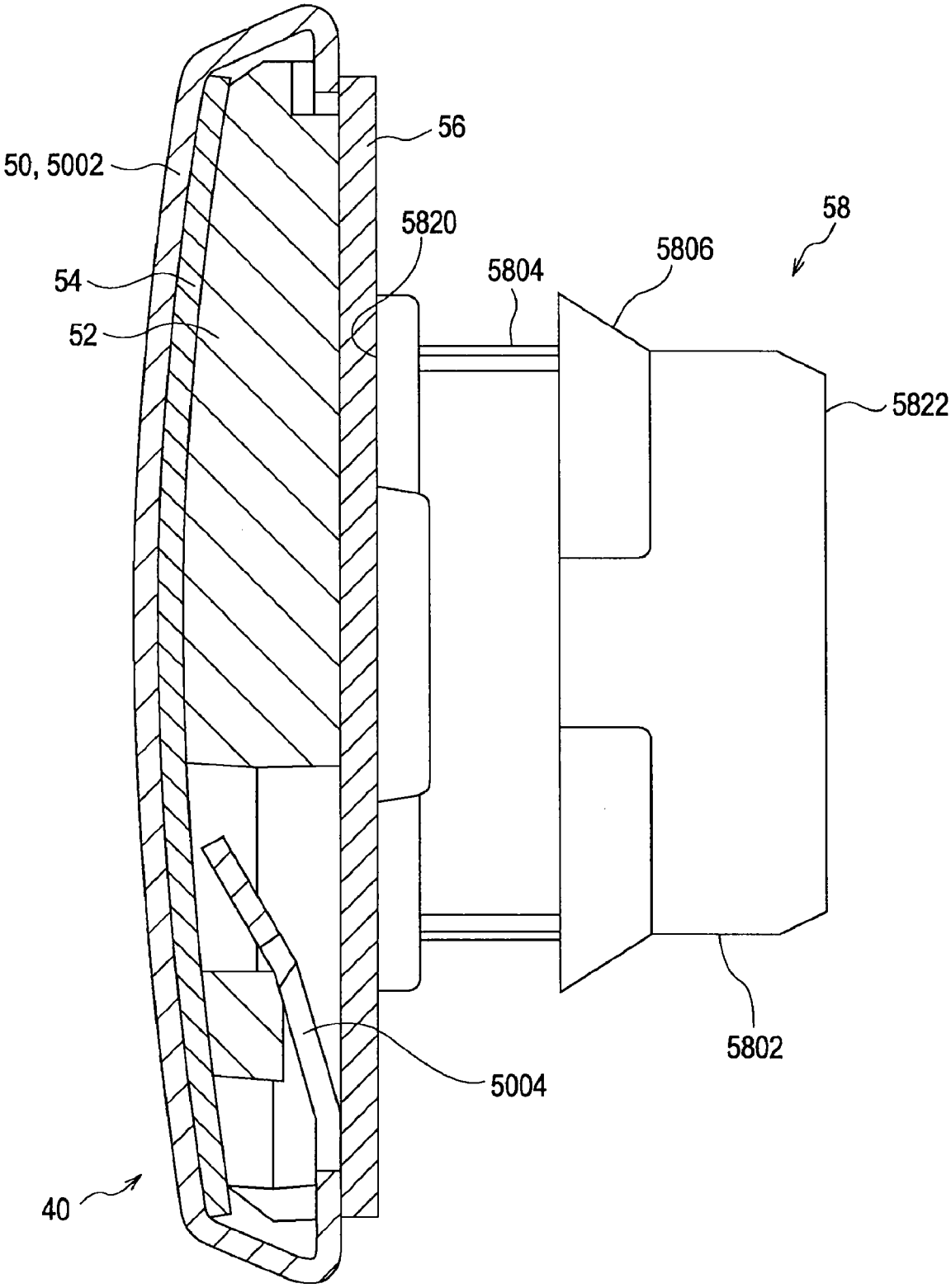
FIG. 15 is a sectional view taken along the line XV-XV in FIG. 14A.
Figure 16:
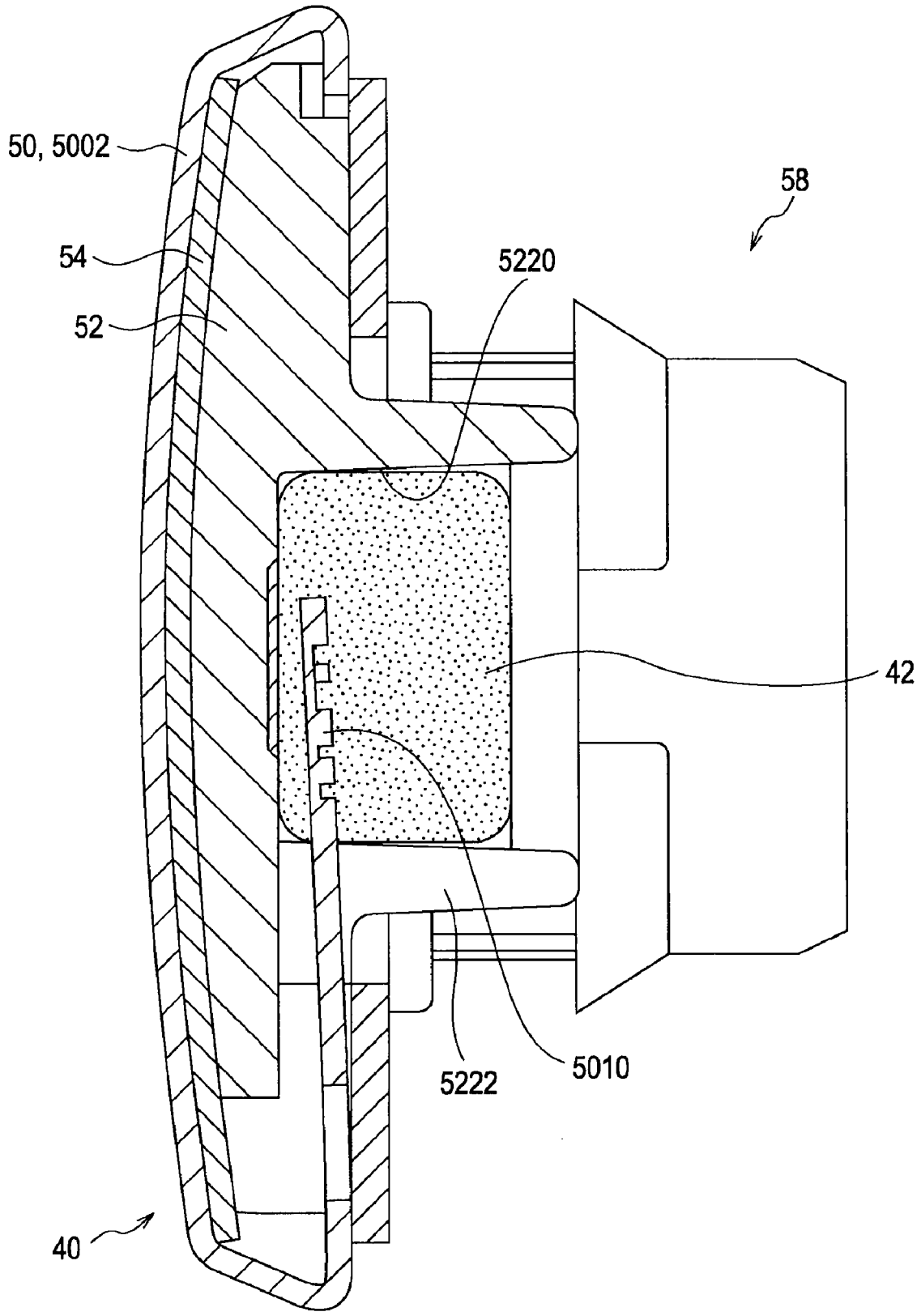
FIG. 16 is a sectional view taken along the line XVI-XVI in FIG. 14A.
Figure 17:
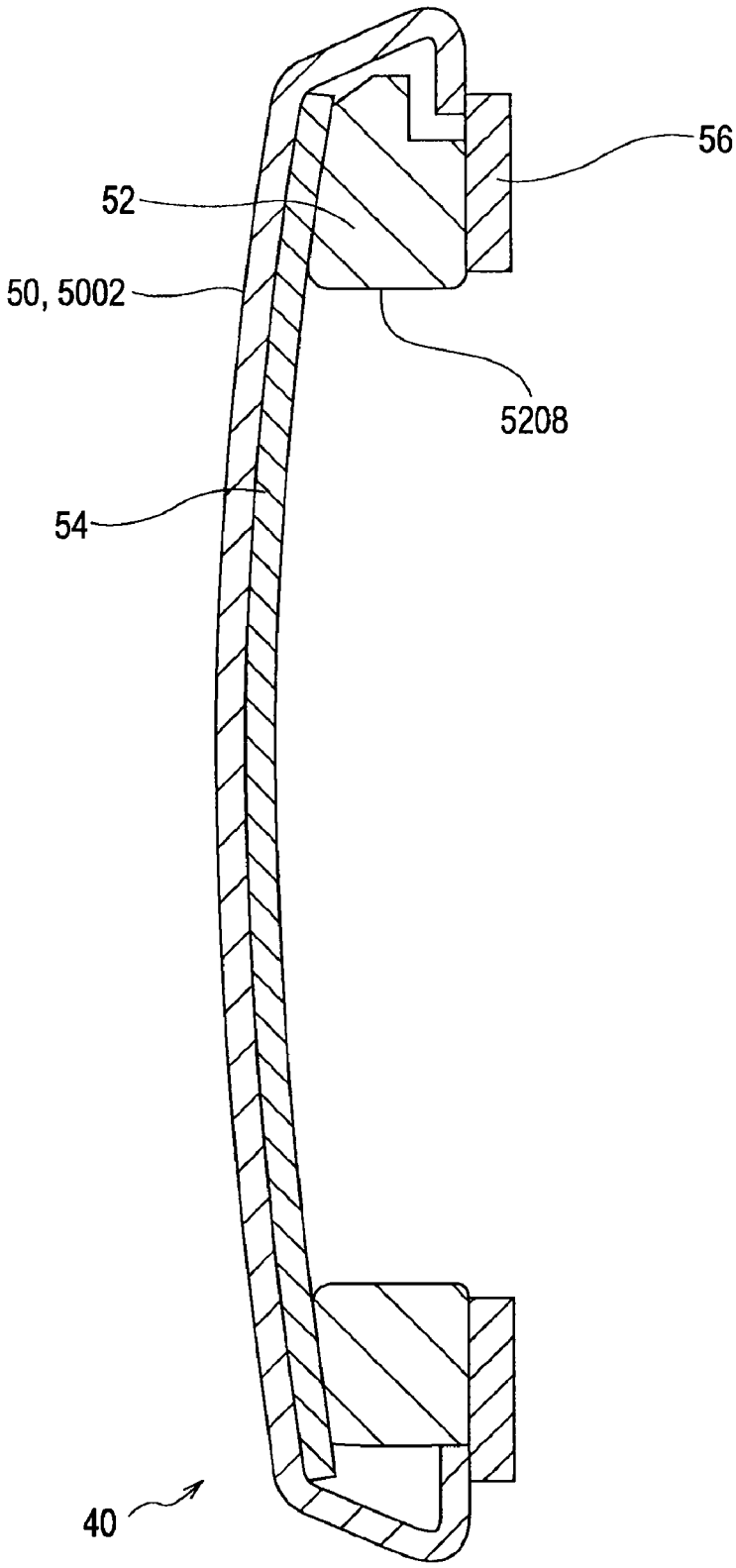
FIG. 17 is a sectional view taken along the line XVII-XVII in FIG. 14A.

FIG. 15 is a sectional view taken along the line XV-XV in FIG. 14A. FIG. 16 is a sectional view taken along the line XVI-XVI in FIG. 14A. FIG. 17 is a sectional view taken along the line XVII-XVII in FIG. 14A.

Figure 18:
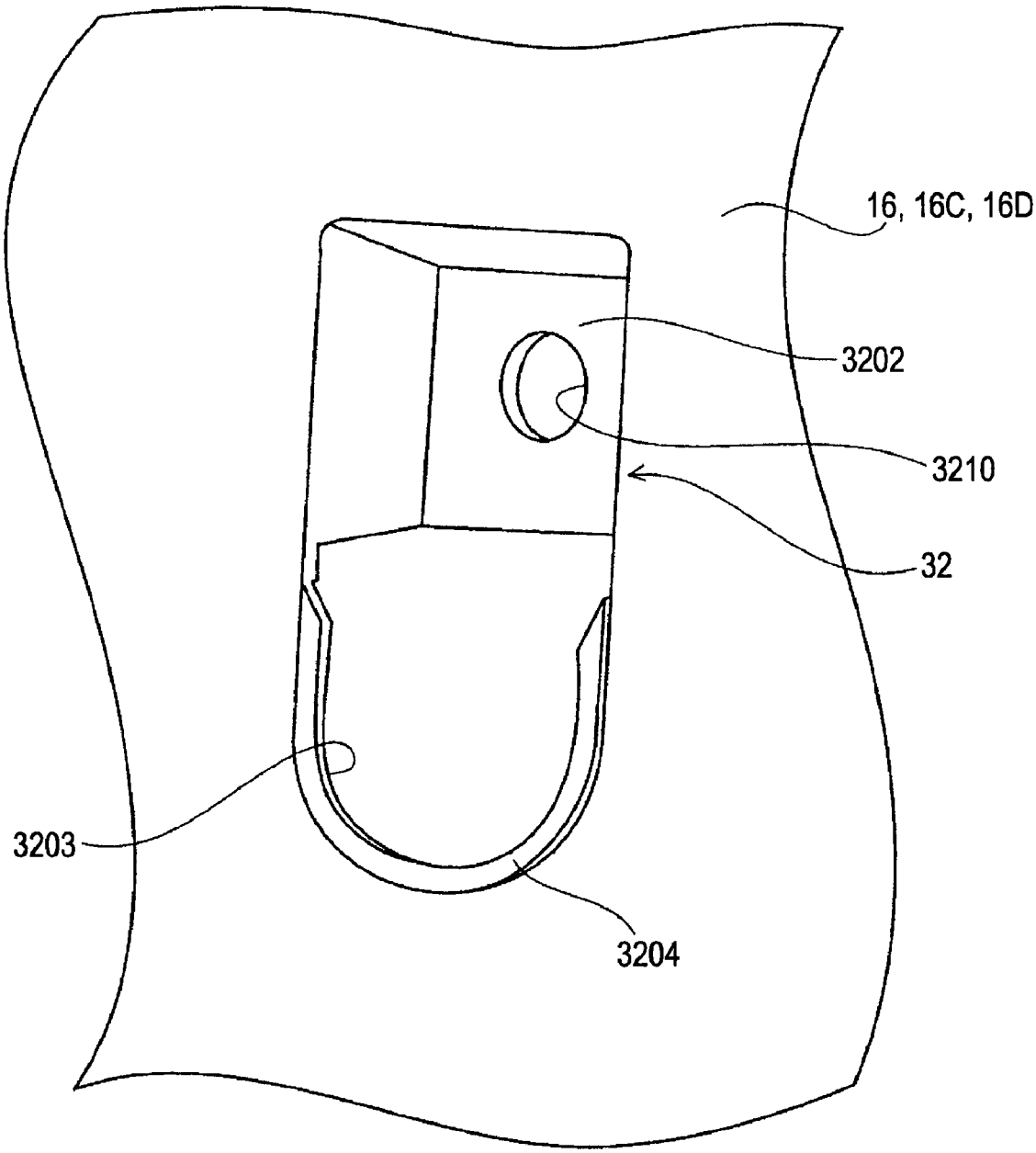
FIG. 18 is a perspective view showing one of the fitting portions 32.
Figure 19:
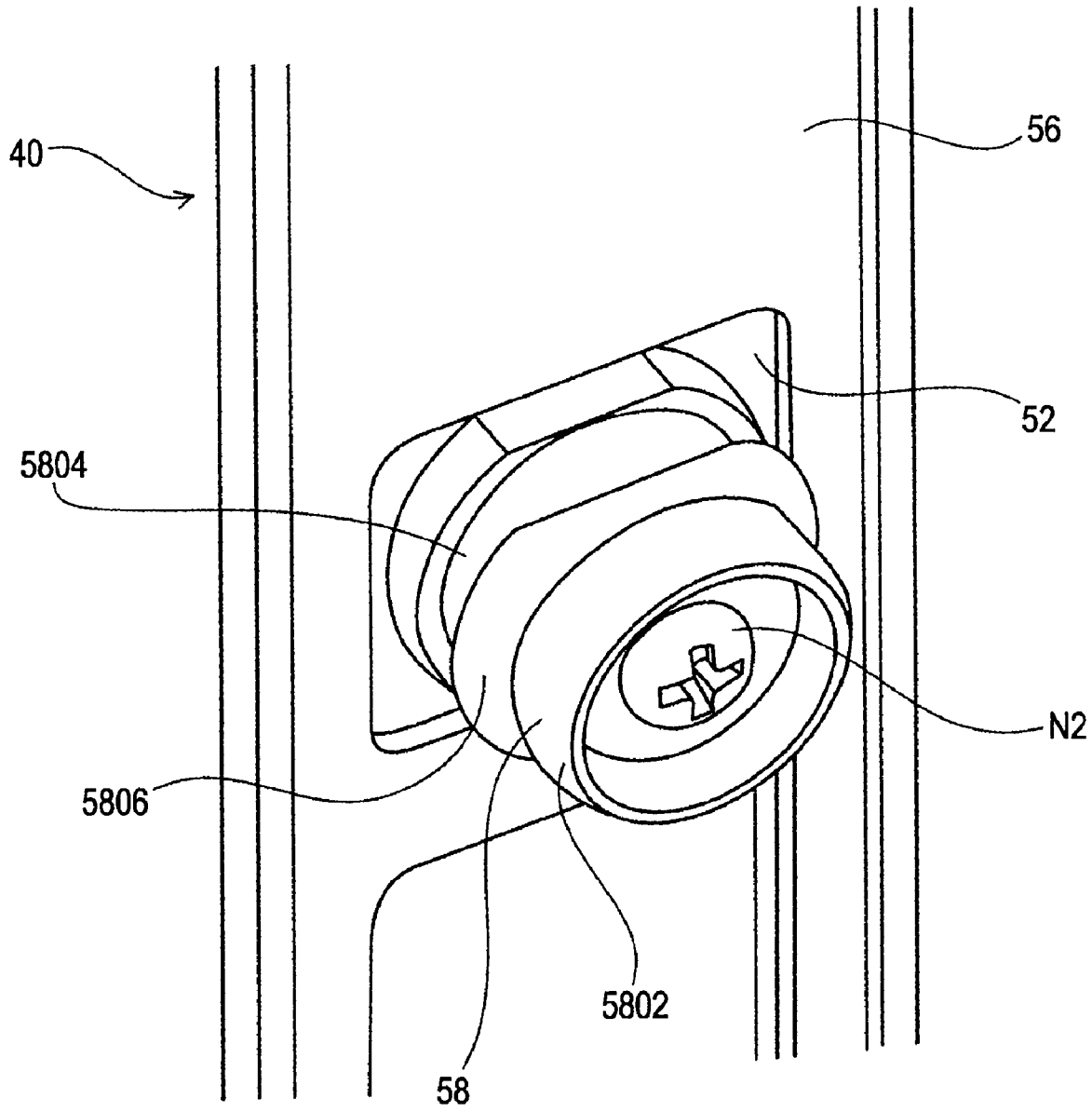
FIG. 19 is a perspective view showing one of fitting members 58.

FIG. 18 is a perspective view showing one of the fitting portions 32. FIG. 19 is a perspective view showing one of the fitting members 58.

Figure 20:
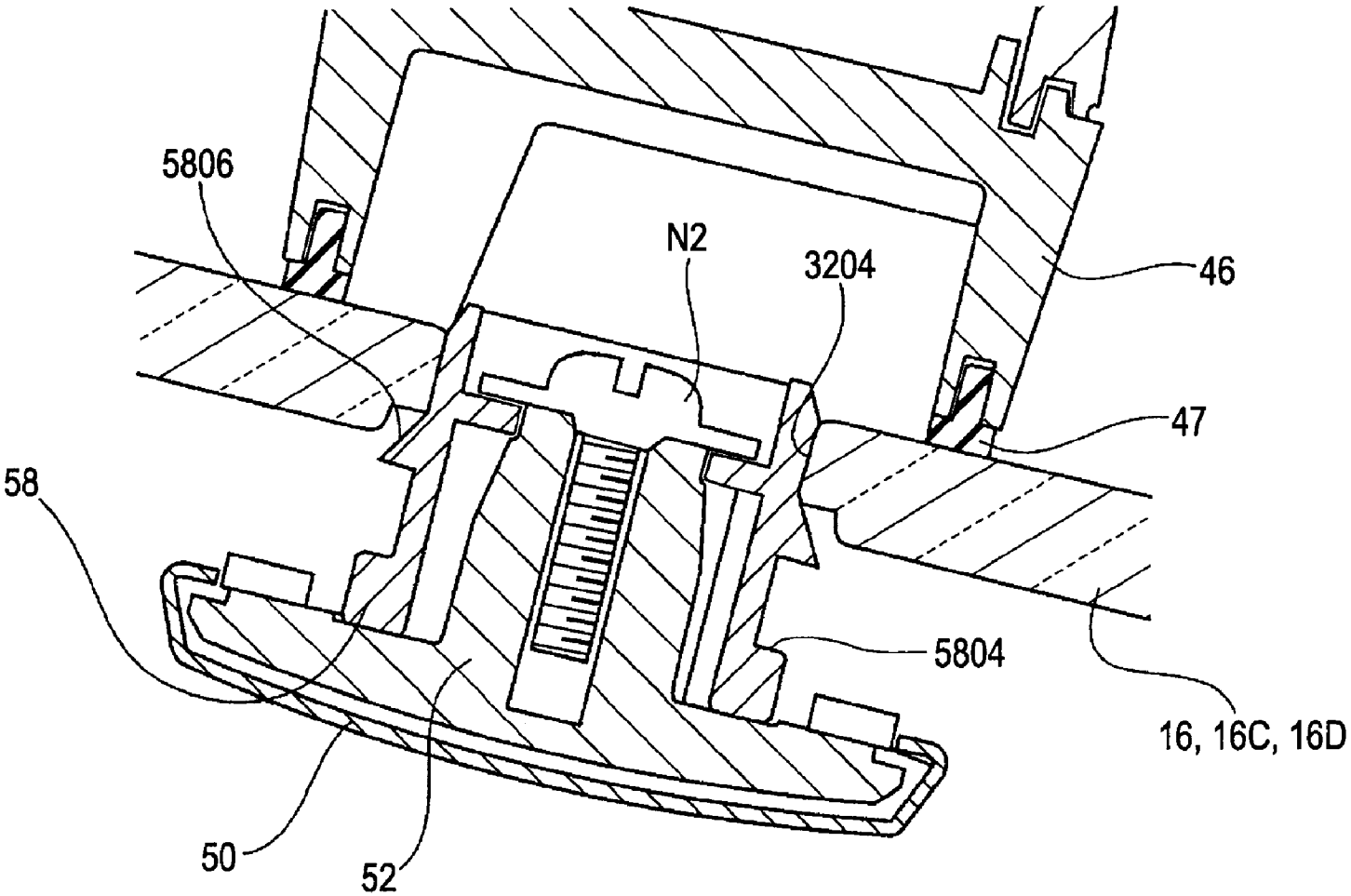
FIG. 20 is an illustrative diagram showing the attachment of the fitting member 58 to the fitting portion 32.
Figure 21:
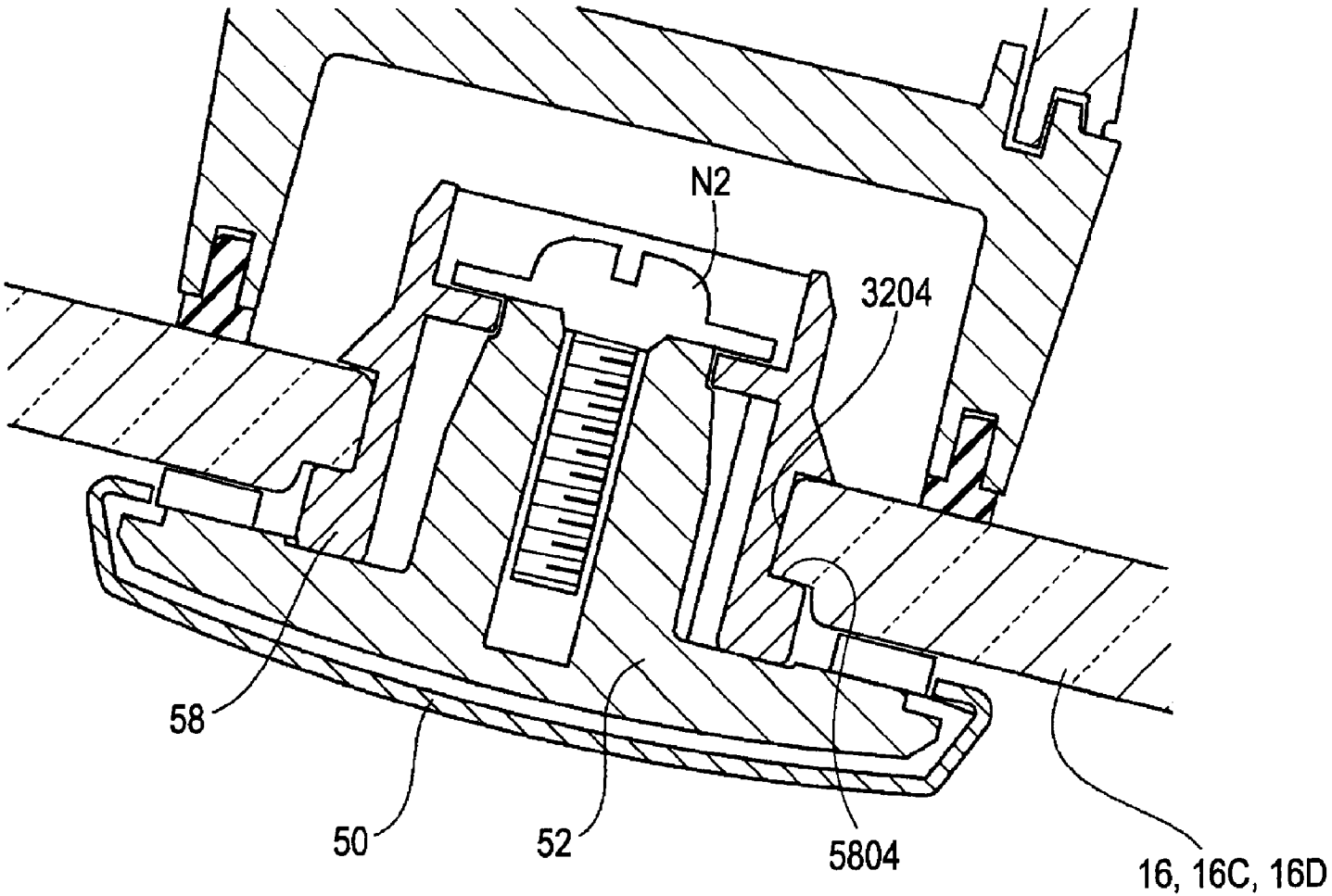
FIG. 21 is another illustrative diagram showing the attachment of the fitting member 58 to the fitting portion 32.

FIGS. 20 and 21 are illustrative diagrams showing the attachment of the fitting member 58 to the fitting portion 32.

Figure 22:
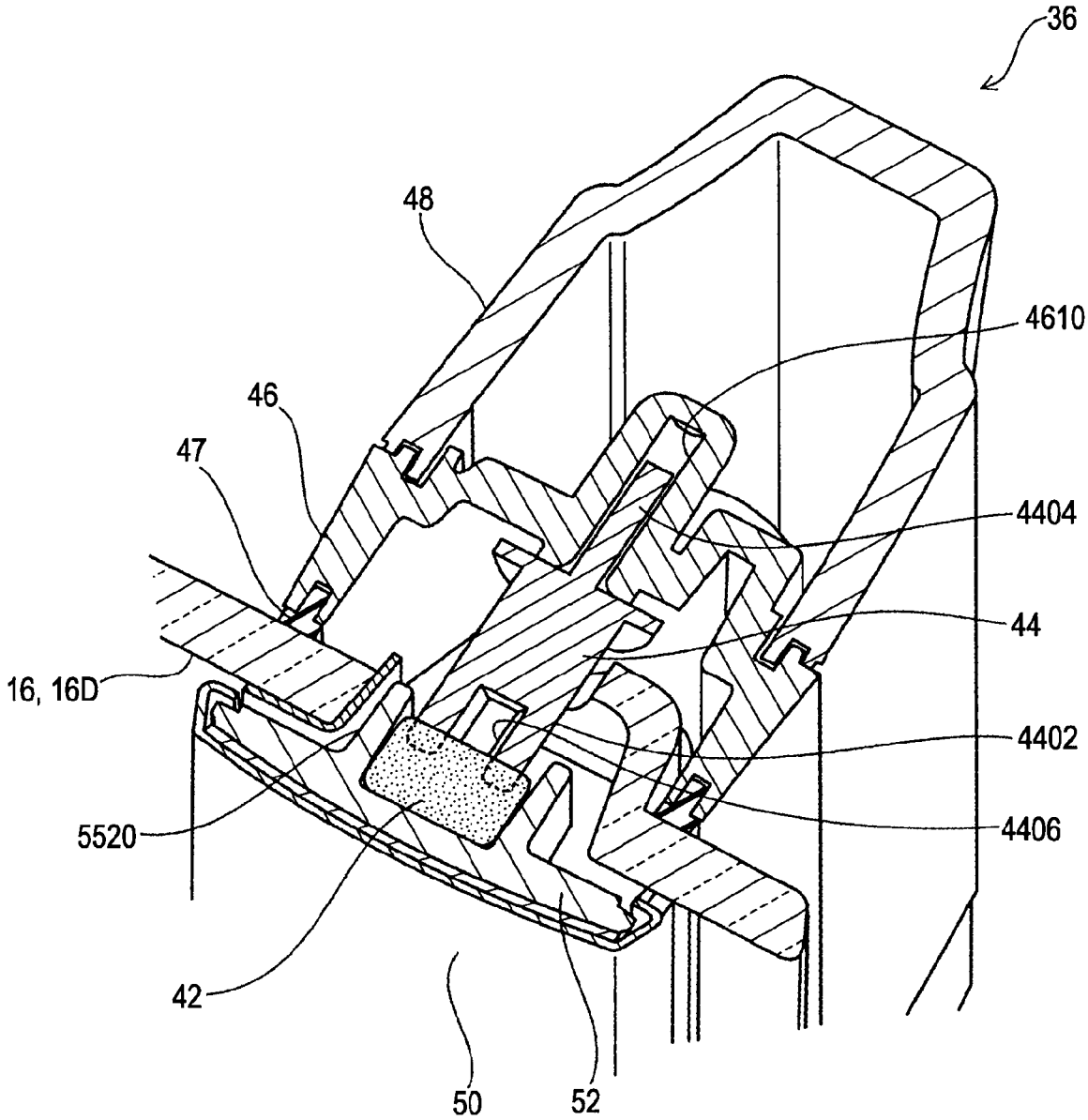
FIG. 22 is a sectional view showing the state of conduction between the cushion member 42 and the conductive member 44.

FIG. 22 is a sectional view showing the state of conduction between the cushion member 42 and the conductive member 44.

Referring to FIGS. 1 and 2, the left and right speakers 22 are provided on the left and right members 16C and 16D, respectively, of the center panel 16.

Referring to FIG. 3, each of the speakers 22 includes one speaker box 36, two speaker units 38, one speaker grille 40, one cushion member 42, one conductive member 44, and so forth.

The left and right speakers 22 have identical configurations. Therefore, description hereinafter will be given focusing on the right speaker 22.

Speaker Box 36

Referring to FIG. 4, the speaker box 36 has a vertically elongated shape.

The speaker box 36 includes a baffle 46 and a rear cabinet 48, and is attached to the right member 16D (the left member 16C) of the center panel 16.

The baffle 46 and the rear cabinet 48 extend over substantially the entirety of the vertical dimension of the right member 16D (the left member 16C).

The baffle 46 is attached to the right member 16D (the left member 16C) with screws (not shown), which pass through the respective screw holes 3210 (FIG. 11) provided in the fitting portions 32 of the right member 16D (the left member 16C) and are screwed into screw holes provided in the baffle 46.

Referring to FIG. 4, a packing 47 made of an elastic material, such as rubber, is provided for prevention of sound leakage, between the baffle 46 and the rear face of the right member 16D (the left member 16C) along the outline of the baffle 46.

The rear cabinet 48 covers the rear of the baffle 46.

Referring to FIG. 4, the rear cabinet 48 is attached to the baffle 46 with screws N1 passing through respective screw holes provided in the baffle 46 and screwed into the rear cabinet 48.

In this embodiment, the speaker box 36 is attached to the electronic-apparatus housing 11. Therefore, it is regarded that the electronic-apparatus housing 11 includes the speaker box 36. With the speaker box 36 integrated into the electronic-apparatus housing 11, the rigidity of the electronic-apparatus housing 11 is increased.

Speaker Unit 38

The two speaker units 38 generate sound by receiving an audio signal from an electronic circuit provided in the housing main body 12. Referring to FIG. 3, the speaker units 38 are arranged vertically with an interval therebetween.

The speaker units 38 are attached to the baffle 46, with the front faces thereof facing the respective sound release holes 30 and the rear faces thereof being covered with the rear cabinet 48.

In short, the speaker units 38 are housed in the speaker box 36 in such a manner as to face the respective sound release holes 30 of the speaker box 36.

Speaker Grille 40

Referring to FIG. 12, the speaker grille 40 includes the grille body 50, a frame 52, a screening member 54, a cover 56, the five fitting members 58, and so forth.

Referring to FIGS. 1 and 2, the speaker grille 40 is provided on the right member 16D (the left member 16C) and is of sufficient size to cover the two sound release holes 30 and the conduction opening 34.

Grille Body 50

Referring to FIG. 12, the grille body 50 has a plate-like shape that is of sufficient size to cover the two sound release holes 30 and the conduction opening 34.

Referring to FIG. 4, the grille body 50 has the front face thereof exposed frontward on the front face of the electronic-apparatus housing 11 (precisely, on the center panel 16).

Referring to FIGS. 13A and 13B, the grille body 50 of this embodiment includes a plate member 5002 having a strip-like shape extending over substantially the entirety of the vertical dimension of the right member 16D (the left member 16C).

The plate member 5002 is made of a conductive material and allows sound to pass therethrough. Specifically, the plate member 5002 is a meshed metal plate or a metal plate punched with a number of holes so that sound can pass therethrough.

With the plate member 5002 made of such a metal material, the texture and appearance of the electronic apparatus 10 is improved.

The plate member 5002 is integrally provided on both longitudinal edges thereof with a plurality of tabs 5004. The tabs 5004 stand upright toward the rear of the plate member 5002.

The plate member 5002 is also integrally provided near the lower end of one of the longitudinal edges thereof with a connection tab 5010 standing upright toward the rear of the plate member 5002. Specifically, in a state where the plate member 5002 covers the two sound release holes 30, the connection tab 5010 projects from the plate member 5002 toward the side on which the speaker units 38 are provided.

With the connection tab 5010 provided on the grille body 50, the cushion member 42 and the grille body 50 can be electrically connected easily, leading to a reduction in the manufacturing cost of the electronic apparatus 10.

In this embodiment, the display panel 14 is held in the electronic-apparatus housing 11, and the speaker units 38 and the grille bodies 50 are provided on the left member 16C and the right member 16D. That is, the speaker units 38 and the grille bodies 50 are provided in the electronic-apparatus housing 11 but outside the display panel 14.

Frame 52

Referring to FIG. 12, the frame 52, which is made of an insulating material, extends over substantially the entirety of the vertical dimension of the right member 16D (the left member 16C).

The frame 52 supports the grille body 50 and is detachably attached to the electronic-apparatus housing 11 (precisely, to the engaging rims 3204 of the fitting portions 32). In a state where the frame 52 is attached to the electronic-apparatus housing 11, the grille body 50 covers the two sound release holes 30.

In this embodiment, the frame 52 includes a plate member 5202 having a strip-like shape and an outline slightly smaller than the outline of the plate member 5002 of the grille body 50.

Referring to FIG. 6, the plate member 5202 has bosses 5204 on the rear face thereof. The bosses 5204 project at positions corresponding to the five fitting portions 32, and each have a screw hole 5206 in the center thereof.

Referring to FIG. 12, the plate member 5202 also has a plurality of openings 5208. The openings 5208 are provided at positions facing the speaker units 38 and the sound release holes 30, and allows sound to pass therethrough.

The plate member 5202 also has recesses 5210 on the longitudinal edges thereof. The recesses 5210 are provided at positions corresponding to the tabs 5004 of the grille body 50, and receives the tabs 5004, respectively.

Referring to FIGS. 12 and 16, the plate member 5202 also has on the rear face thereof a receiving wall member 5220 having a rectangular frame-like shape. The receiving wall member 5220 is provided at a position corresponding to the connection tab 5010 of the grille body 50 and receives the cushion member 42.

The receiving wall member 5220 has a notch 5222 that guides the connection tab 5010 into a space surrounded by the receiving wall member 5220.

With the receiving wall member 5220 provided as described above, the cushion member 42 can be attached easily, leading to a reduction in the manufacturing cost of the electronic apparatus 10.

Screening Member 54

Referring to FIG. 12, the screening member 54 has a vertical length and a horizontal width that are the same as those of the plate member 5002 of the grille body 50.

The screening member 54 is, for example, a piece of black cloth.

The screening member 54 covers the rear face of the plate member 5002, thereby preventing mechanisms and components provided behind the grille body 50 from being visible through the grille body 50 for more aesthetic appearance.

Cover 56

Referring to FIG. 12, the cover 56 has a vertical length and a horizontal width that are the same as those of the plate member 5202 of the frame 52.

The cover 56 has openings provided in correspondence with the two sound release holes 30, the conduction opening 34, and the bosses 5204.

The cover 56 is attached to the rear face of the plate member 5202 of the frame 52, thereby contributing to an aesthetic appearance of the speaker grille 40 when the speaker grille 40 is used on the stand-alone basis.

Fitting Member 58

Referring to FIGS. 6, 12, and 15, the fitting members 58 are made of an elastic member, such as rubber, and each have a cylindrical portion 5802.

Referring to FIGS. 6 and 15, when one end of the cylindrical portion 5802 in the axial direction is defined as a base 5820 and the other end as a tip 5822, the cylindrical portion 5802 is provided with an engagement groove 5804 around the outer periphery near the base 5820 thereof.

The engagement groove 5804 engages with the engaging rim 3204 (FIGS. 11A to 11C) of the corresponding fitting portion 32 of the center panel 16.

The cylindrical portion 5802 is also provided with a guide surface 5806 around the outer periphery thereof between the engagement groove 5804 and the tip 5822. The guide surface 5806 is the sloping surface of a conical portion provided on the cylindrical portion 5802, the conical portion having a diameter that gradually increases in the axial direction toward the engagement groove 5804.

Referring to FIG. 6, the cylindrical portion 5802 is also provided with an annular plate-like inner flange 5808 around the inner periphery near the tip 5822 thereof. The inner flange 5808 has in the center thereof a boss insertion hole 5810 into which a corresponding one of the bosses 5204 of the frame 52 is fitted.

The speaker grille 40 is assembled as follows.

Referring to FIG. 12, the screening member 54 and the frame 52 are placed in that order on the rear face of the plate member 5002 of the grille body 50. Referring now to FIG. 14C, the tabs 5004 of the grille body 50, projecting on the rear face of the frame 52 in the foregoing state, are folded into the recesses 5210.

Thus, the screening member 54 and the frame 52 are secured between the plate member 5002 and the tabs 5004.

Referring again to FIG. 14C, the cover 56 is bonded to the rear face of the frame 52 with double-sided adhesive tape or the like.

Referring now to FIG. 6, the fitting members 58 are placed such that the bases 5820 thereof face the respective bosses 5204 of the frame 52, and are fitted to the bosses 5204 such that the bosses 5204 are received in the respective boss insertion holes 5810 of the fitting members 58.

Subsequently, with the bases 5820 of the fitting members 58 being in contact with the rear face of the cover 56, screws N2 are screwed into the screw holes 5206 until the heads of the screws N2 come into contact with the respective flanges 5808. Thus, the fitting members 58 are secured to the frame 52.

Cushion Member 42

Referring to FIGS. 5, 7, and 16, the cushion member 42 is provided on the frame 52 so as to be electrically continuous with the grille body 50.

The cushion member 42 is made of a conductive, elastic material. The material may be any of various common materials.

Referring to FIGS. 5 and 16, the cushion member 42 of this embodiment has an elongated columnar shape with a rectangular cross section.

Referring to FIG. 16, the connection tab 5010 of the grille body 50 is bent beforehand so as to be placed in the space surrounded by the receiving wall member 5220 of the frame 52. In this state, the cushion member 42 is fitted into the space surrounded by the receiving wall member 5220. The cushion member 42 is bonded to the receiving wall member 5220 with adhesive or the like.

Thus, the cushion member 42 comes into contact with the connection tab 5010 and accordingly becomes electrically continuous with the grille body 50.

Conductive Member 44

Referring to FIGS. 5 and 7, the conductive member 44, which is grounded inside the electronic-apparatus housing 11, becomes electrically continuous with the grille body 50 through the cushion member 42 when the frame 52 is attached to the electronic-apparatus housing 11 (precisely, to the engaging rims 3204 of the fitting portions 32).

The conductive member 44 of this embodiment is made of metal.

The conductive member 44 has an elongated shape, with a portion thereof in the longitudinal direction forming a rod 4402 having a circular cross section and the rest forming an external thread 4404 provided coaxially with the rod 4402 and having a smaller diameter than the rod 4402.

The rod 4402 has at the tip thereof a fitting hole 4406 extending coaxially with the rod 4402 and having a hexagonal cross section. Thus, the fitting hole 4406 can receive a hexagonal wrench.

The rod 4402 has at the base thereof a flange 4407.

The external thread 4404 can be screwed into a screw hole 4610 provided in the baffle 46.

Referring to FIGS. 5, 7, and 10, the conductive member 44, oriented such that the tip of the rod 4402 thereof faces the conduction opening 34, is secured to the baffle 46 by having the external thread 4404 thereof screwed into the screw hole 4610 of the baffle 46.

With the conductive member 44 having such a shape, the conductive member 44 can be easily attached to the electronic-apparatus housing 11 (precisely, to the baffle 46), leading to a reduction in the manufacturing cost of the electronic apparatus 10.

Attachment of Speaker Grille 40

The attachment of the speaker grille 40 will now be described.

After the securing of the cushion member 42 to the speaker grille 40 that has been assembled as described above, referring now to FIGS. 18 and 19, the speaker grille 40 is positioned such that the fitting members 58 face the respective fitting portions 32 of the right member 16D (the left member 16C) of the center panel 16.

Then, the fitting members 58 are placed into the respective recesses 3202 of the fitting portions 32, and the rear face of the speaker grille 40 (the rear face of the cover 56) is pressed against the front face of the right member 16D (the left member 16C).

Subsequently, the speaker grille 40 is moved downward so that the engagement grooves 5804 of the fitting members 58 engage with the engaging rims 3204 of the fitting portions 32, respectively. This causes the cushion member 42 to come into contact with the tip of the conductive member 44, as shown in FIGS. 5, 7, and 22.

Thus, the speaker grille 40 is attached to the electronic-apparatus housing 11, with the grille body 50 being grounded through the cushion member 42 and the conductive member 44.

As described above, to engage the engagement grooves 5804 of the fitting members 58 with the engaging rims 3204 of the fitting portions 32, respectively, the fitting members 58 are first placed into the respective recesses 3202 and then the speaker grille 40 is moved downward. This engaging process may alternatively be performed in the following manner.

Referring to FIG. 20, the guide surfaces 5806 of the fitting members 58 are first pressed against the engaging rims 3204 of the fitting portions 32, respectively, from the front.

In this state, the speaker grille 40 is pushed into the right member 16D (the left member 16C). Accordingly, referring to FIG. 21, the guide surfaces 5806 that are being pressed against the engaging rims 3204 undergo elastic deformation. Consequently, the engagement grooves 5804 engage with the engaging rims 3204, respectively.

Also in this alternative process, the cushion member 42 comes into contact with the base of the conductive member 44, whereby the grille body 50 is grounded through the cushion member 42 and the conductive member 44.

Thus, the attachment of the speaker grille 40 is completed, as shown in FIG. 1.

To remove the speaker grille 40 from the electronic-apparatus housing 11, the speaker grille 40 is moved upward, whereby the engagement between the engagement grooves 5804 of the fitting members 58 and the engaging rims 3204 of the fitting portions 32 is released first. Subsequently, the speaker grille 40 is moved frontward.

To summarize, according to the foregoing embodiment of the present invention, attaching the grille body 50 and the frame 52 to the electronic-apparatus housing 11 (precisely, to the engaging rims 3204 of the fitting portions 32) makes the grille body 50 grounded through the cushion member 42 and the conductive member 44.

In the case where a grille body that is made of a conductive material, such as metal, for aesthetic texture and appearance is removably provided on an electronic-apparatus housing, the configuration described in the foregoing embodiment is advantageous in that the grille body 50 is assuredly grounded and electrostatic charging is prevented.

Moreover, in the case where a user of an electronic apparatus desires to change the appearance of the electronic apparatus by changing a grille body for another one among various kinds of grille bodies, the configuration described in the foregoing embodiment can eliminate annoying work including reconnection of a grounding lead wire from one grille body to another. Accordingly, the usability of the electronic apparatus is advantageously improved, together with the commercial value thereof.

While the embodiment described above concerns the case where the electronic apparatus 10 is a television receiver or a display apparatus, the present invention may also be applied to a wide variety of electronic apparatuses including speakers.

The present application contains subject matter related to that disclosed in Japanese Priority Patent Application JP 2008-206635 filed in the Japan Patent Office on Aug. 11, 2008, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An electronic apparatus comprising:

an electronic-apparatus housing provided with a sound release hole;

a speaker unit housed in the electronic-apparatus housing and facing the sound release hole;

a grille body made of a conductive material, configured to allow sound to pass therethrough, and having a plate-like shape that is of sufficient size to cover the sound release hole;

a frame made of an insulating material and detachably attached to the electronic-apparatus housing while supporting the grille body, such that the grille body covers the sound release hole;

a cushion member provided on the frame and having elasticity and conductivity that allows the cushion member to be electrically continuous with the grille body; and a conductive member grounded inside the electronic-apparatus housing and, when the frame is attached to the electronic-apparatus housing, becoming electrically continuous with the grille body through the cushion member.

2. The electronic apparatus according to claim 1, further comprising a display panel held in the electronic-apparatus housing, wherein the speaker unit and the grille body are positioned inside the electronic-apparatus housing and outside the display panel.

3. The electronic apparatus according to claim 1, wherein the speaker unit is housed in a speaker box, the speaker box being attached to the electronic-apparatus housing, whereby the speaker box is included in the electronic-apparatus housing.

4. The electronic apparatus according to claim 1, wherein the conductive member has an elongated shape with a portion thereof in a longitudinal direction forming a rod having a circular cross section and the rest forming an external thread provided coaxially with the rod and having a smaller diameter than the rod, the rod having at a tip thereof a fitting hole extending coaxially with the rod, the fitting hole being capable of receiving a hexagonal wrench.

5. The electronic apparatus according to claim 1, wherein the grille body includes a plate member configured to cover the sound release hole; and a connection tab projecting, in a state where the plate member covers the sound release hole, from the plate member toward a side on which the speaker unit is provided, and wherein the cushion member and the grille body become electrically continuous with each other when the connection tab comes into contact with the cushion member.

6. The electronic apparatus according to claim 1, wherein a front face of the grille body is exposed frontward on a front face of the electronic-apparatus housing, wherein the grille body is supported at a rear face thereof by the frame, wherein the frame has a receiving wall member having a rectangular frame-like shape and projecting rearward, and wherein the cushion member is received by the receiving wall member.

* * * * *